US010211528B2

(12) United States Patent
Assefzadeh et al.

(10) Patent No.: US 10,211,528 B2
(45) Date of Patent: Feb. 19, 2019

(54) FULLY PROGRAMMABLE DIGITAL-TO-IMPULSE RADIATING ARRAY

(71) Applicants: Mohammad Mahdi Assefzadeh, Houston, TX (US); Aydin Babakhani, Houston, TX (US)

(72) Inventors: Mohammad Mahdi Assefzadeh, Houston, TX (US); Aydin Babakhani, Houston, TX (US)

(73) Assignee: WILLIAM MARSH RICE UNIVERSITY, Houston, TX (US)

( * ) Notice: Subject to any disclaimer, the term of this patent is extended or adjusted under 35 U.S.C. 154(b) by 266 days.

(21) Appl. No.: 15/157,889

(22) Filed: May 18, 2016

(65) Prior Publication Data

US 2016/0344108 A1 Nov. 24, 2016

Related U.S. Application Data

(60) Provisional application No. 62/241,850, filed on Oct. 15, 2015, provisional application No. 62/163,012, filed on May 18, 2015.

(51) Int. Cl.
*H01Q 3/26* (2006.01)
*H01Q 3/38* (2006.01)
(Continued)

(52) U.S. Cl.
CPC ..... *H01Q 3/2682* (2013.01); *H01Q 3/38* (2013.01); *H01Q 13/085* (2013.01); *H01Q 21/064* (2013.01)

(58) Field of Classification Search
CPC ..... H01Q 3/2682; H01Q 3/38; H01Q 13/085; H01Q 21/064; H01Q 3/26; H01Q 3/36; H01Q 25/00; H01Q 3/22
(Continued)

(56) References Cited

U.S. PATENT DOCUMENTS 6,434,366 B1 * 8/2002 Harrison ..... H01Q 3/2605 342/372
8,884,807 B1 * 11/2014 Johansson ..... G01S 13/885 342/175
(Continued)

FOREIGN PATENT DOCUMENTS

JP 2007333404 A * 12/2007

OTHER PUBLICATIONS

M. Mahdi Assefzadeh, et al. Broadband 0.03-1.032THz Signal Generation and Radiation with Peak EIRP of 30dBm Based on a Fully-Integrated 4×2 Impulse Radiating Array with Programmable Delay per Element in 90nm SiGe BiCMOS; Infrared Millimeter and Terahertz waves (IRMMW-THz) 2016 41st International Conference (Sep. 2016).
(Continued)

*Primary Examiner* — Harry K Liu
(74) *Attorney, Agent, or Firm* — Winstead PC

(57) ABSTRACT

A fully-programmable digital-to-impulse radiator with a programmable delay is discussed herein. The impulse radiator may be part of an array of impulse radiators. Each individual element of the array may be equipped with an integrated programmable delay that can shift the timing of a digital trigger. The digital trigger may be fed to an amplifier, switch, and impulse matching circuitry, whereas the data signal path may be provided from a separate path. An antenna coupled to the impulse matching circuitry may then radiate ultra-short impulses. The radiating array may provide the ability to control delay at each individual element, perform near-ideal spatial combing, and/or beam steering.

23 Claims, 23 Drawing Sheets

(51) Int. Cl.
*H01Q 13/08* (2006.01)
*H01Q 21/06* (2006.01)

(58) Field of Classification Search
USPC ..... 342/372
See application file for complete search history.

(56) References Cited

U.S. PATENT DOCUMENTS

| | | | | |
|---|---|---|---|---|
| 2003/0053554 | A1* | 3/2003 | McCrokle | H04B 1/71632 375/295 |
| 2005/0099942 | A1* | 5/2005 | Kurihara | H04W 64/00 370/229 |
| 2007/0109099 | A1* | 5/2007 | Raphaeli | G01S 13/758 340/10.2 |
| 2011/0084880 | A1* | 4/2011 | Sakai | G01S 7/282 342/375 |
| 2013/0176158 | A1* | 7/2013 | Kim | G04F 10/005 341/166 |
| 2014/0047198 | A1* | 2/2014 | Stein | G01R 13/0254 711/154 |
| 2014/0269414 | A1* | 9/2014 | Hyde | H04L 41/0803 370/254 |
| 2014/0369323 | A1* | 12/2014 | Grankin | H03L 7/00 370/336 |
| 2015/0285907 | A1* | 10/2015 | Mohamadi | H01Q 3/24 342/21 |
| 2016/0223669 | A1* | 8/2016 | Assefzadeh | E21B 47/0002 |

OTHER PUBLICATIONS

M. Mahdi Assefzadeh and Aydin Babakhani. Broadband Beamforming of Terahertz Pulses in Silicon with a Single-Chip 4×2 Array; Antennnas and Propagation (APSURI) 2016 IEEE International Symposium on 2016.

M. M. Assefzadeh, B. Jamali, A. K. Gluszek, A. J. Hudzikowski, J. Wojtas, F. Tittel, and A. Babakhani, "Terahertz Trace Gas Spectroscopy Based on a Fully-Electronic Frequency-Comb Radiating Array in Silicon," in *Conference on Lasers and Electro-Optics*, OSA Technical Digest (2016) (Optical Society of America, 2016), paper SM2L.7.

M. Mahdi Assefzadeh, et al. A Fully-Integrated Digitally-Programmable 4×4 Picosecond Digital-to-Impulse Radiating Array in 65nm Bulk CMOS; Microwave Symposium (IMS), 2016 IEEE MTT-S International, May 1-4, 2016.

M. Mahdi Assefzadeh and Aydin Babakhani. Broadband 0.03-1.03THz Spectroscopic Imaging based on a Fully-Integrated 4×2 Digital-to-Impulse Radiating Array in Silicon; VLSI Technology, 2016 IEEE Symposium on 2016.

A. Arbabian, et. al., "A 94 GHz mm-Wave-to-Baseband Pulsed-Radar Transceiver with Applications in Imaging and Gesture Recognition," JSSC, vol. 48, No. 4, pp. 1055,1071, Apr. 2013.

X. Wu et. al, "Programmable Picosecond Pulse Generator in CMOS," in IEEE MTT-S Int. Microwave Symposium, Jun. 2015.

M. Assefzadeh, et. al., "An 8-psec 13dBm Peak EIRP Digital-to-Impulse Radiator with an On-chip Slot Bow Tie Antenna in Silicon," Microwave Symposium (IMS), 2014 IEEE MTT-S International , vol., No., pp. 1,4, Jun. 1-6, 2014.

P. Chen et. al, "A 30GHz Impulse Radiator with On-Chip Antennas for High-Resolution 3D Imaging," in IEEE Radio and Wireless Symp. Dig. Papers, Jan. 2015.

M. M. Assefzadeh and A. Babakhani, "A 9-psec differential lensless digital-to-impulse radiator with a programmable delay line in silicon," Radio Frequency Integrated Circuits Symposium, 2014 IEEE , vol., No., pp. 307,310, Jun. 1-3, 2014.

N. Llombart, et al., "Novel Terahertz Antenna Based on a Silicon Lens Fed by a Leaky Wave Enhanced Waveguide," in Antennas and Propagation, IEEE Transactions on , vol. 59, No. 6, pp. 2160-2168, Jun. 2011.

D.F. Filipovic, et al., "Off-axis properties of silicon and quartz dielectric lens antennas," in Antennas and Propagation, IEEE Transactions on, vol. 45, No. 5, pp. 760-766, May 1997.

Y. Hsieh, et al., "Terahertz Comb Spectroscopy Traceable to Microwave Frequency Standard," IEEE Trans. Terahertz Sci. Technol. 3(3), 322-330 (2013).

A.S. Skryl, et al., "High-resolution terahertz spectroscopy with a single tunable frequency comb," Opt. Express 22, 32376-32281 (2014).

* cited by examiner

MAGNETIC DC ENERGY-DENSITY DISTRIBUTION

COLOR-GRAPHED RADIATED E-FIELD

*Trigger-based beamforming*

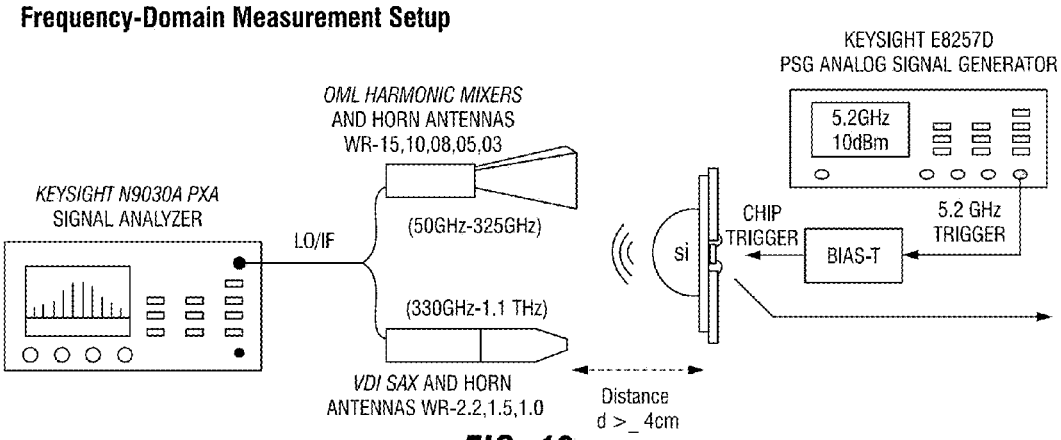
FIG. 19
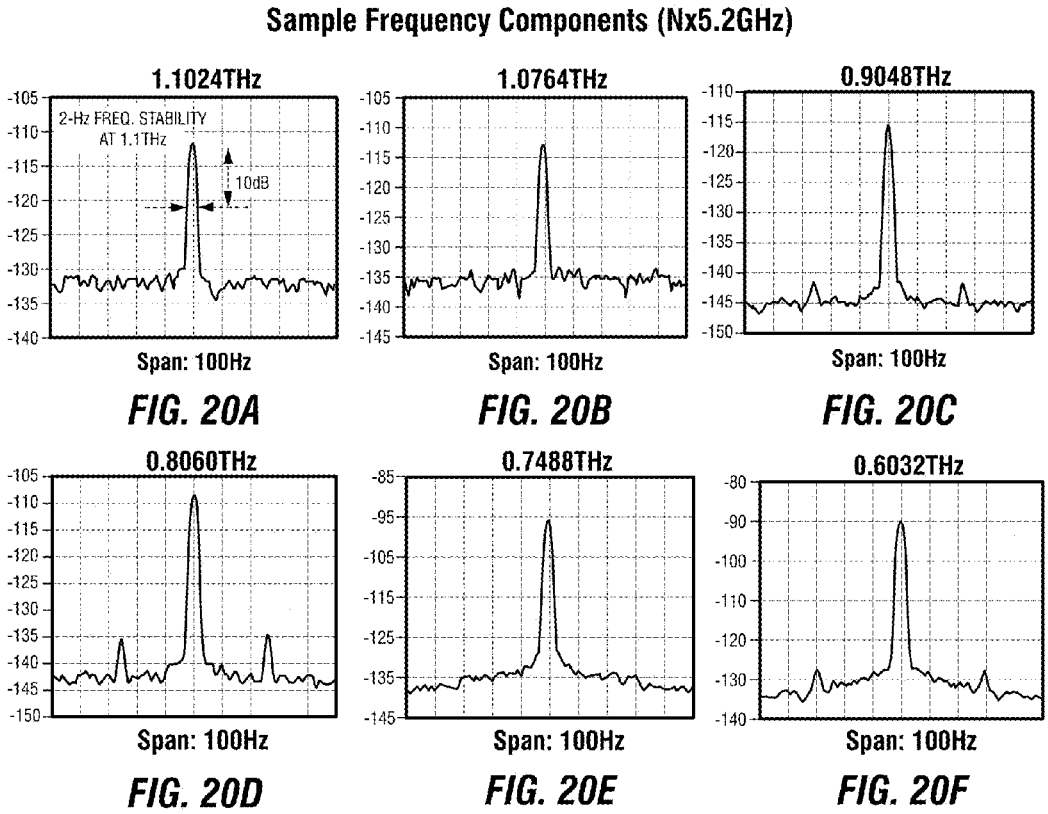
FIG. 20A FIG. 20B FIG. 20C
FIG. 20D FIG. 20E FIG. 20F

FULLY PROGRAMMABLE DIGITAL-TO-IMPULSE RADIATING ARRAY

RELATED APPLICATIONS

This application claims the benefit of U.S. Provisional Patent Application No. 62/163,012 filed on May 18, 2015 and 62/241,850 filed on Oct. 15, 2015, which are incorporated herein by reference.

STATEMENT REGARDING FEDERALLY SPONSORED RESEARCH

This invention was made with government support under Grant No. N66001-12-1-4214 from the Department of Defense, SPAWAR Systems Center (SSC) Pacific. The government has certain rights in the invention.

FIELD OF THE INVENTION

This invention relates to digital-to-impulse radiating array. More particularly, to a fully-programmable radiating array.

BACKGROUND OF INVENTION

There has been a growing interest for generation and radiation of ultra-short impulses in silicon. These impulses can be used in 3D imaging radars, spectroscopy, high-speed wireless communication, and precision time/frequency transfer. Today, in the realm of Terahertz (THz), pulse radiating systems are based on two conventional methods. The first method employs a femtosecond-laser-based photoconductive antenna (PCA) that is usually fabricated on a III-V semiconductor substrate. A femtosecond-laser-based THz time-domain spectroscopy (THz-TDS) system has been built based on the vastly researched terahertz photoconductive antennas (PCA). However, there are several critical limitations with current THz-TDS systems, including the need for a laser, limited average radiated power, and need to move the imaging target mechanically. In the second method, oscillator-based integrated circuits are designed that radiate mm-wave pulses in silicon. Current silicon-based pulse radiating systems are based on on-chip voltage-controlled oscillators (VCO) and/or power amplifiers (PA) as switches such as, work using the phase of the carrier signal synchronized to an external reference with a phase-locked loop (PLL). However, there are several limitations with this method of pulse generation, including bandwidth limitations, RF leakage, power demands, and limited scalability.

Ideally, the impulses should be very short in time and provide a large peak power. Their pulse width limits the depth resolution and their peak power determines the range of the measurement. Impulse generation methods can be divided into two main categories. In the first category, a continuous-wave signal is generated on-chip and a switch is used to modulate the amplitude of the continuous-wave and convert it to short impulses. For example, the shortest radiated impulse reported with this method is 26 psec, which was based on a noisy envelope of the radiated signal.

The second category is based on the technique of direct digital-to-impulse radiation, which was introduced for the first time in M. M. Assefzadeh and A. Babakhani, "A 9-psec differential lens-less digital-to-impulse radiator with a programmable delay line in silicon," Radio Frequency Integrated Circuits Symposium, 2014 IEEE, vol., no., pp. 307, 310, 1-3 Jun. 2014; and M. M. Assefzadeh and A. Babakhani, "An 8-psec 13 dBm peak EIRP digital-to-impulse radiator with an on-chip slot bow-tie antenna in silicon," Microwave Symposium (IMS), 2014 IEEE MTT-S International, vol., no., pp. 1, 4, 1-6 Jun. 2014. In this technique, no on-chip oscillator was used. Instead, a fast trigger signal is generated and used to release the DC energy stored in a broadband on-chip antenna. For example, radiation of 9-psec impulses may use an on-chip differential inverted-cone antenna. Further, 8-psec impulses may be radiated using an on-chip slot bow-tie antenna. Such chips may be based on a single element and without on-chip delay control. Furthermore, these impulse radiators may be fabricated using a 130 nm SiGe BiCMOS process. In the prior application PCT/US2014/058019 filed on Sep. 29, 2014, direct digital-to-impulse high-resolution radar imaging systems and methods were disclosed.

The fully-programmable digital-to-impulse radiating array discussed herein provides the ability to control delay at each individual element, near-ideal spatial combing, and beam steering.

SUMMARY OF INVENTION

In one embodiment, a digital-to-impulse radiator with a programmable delay is provided. The impulse radiator may be equipped with an integrated programmable delay that can shift the timing of a trigger signal (e.g. digital trigger) by a desired amount of time. Notably, the information or data path is separated from the trigger path. The digital trigger may be fed to an amplifier, switch, and impulse matching circuitry. An antenna coupled to the impulse matching circuitry may then radiate ultra-short impulses. The impulse radiator may be part of an array of impulse radiators, such as, but not limited to, a 4×2 array, 4×4 array, or the like. The array may provide the ability to control delay at each individual element, near-ideal spatial combing, and beam steering.

In yet another embodiment, a fully-programmable digital-to-impulse radiating array with a programmable delay at each element is provided. Each individual element of the array may be equipped with an integrated programmable delay that can shift the timing of a digital trigger. The digital trigger may be fed to an amplifier, switch, and impulse matching circuitry. An antenna coupled to the impulse matching circuitry may then radiate ultra-short impulses. The radiating array may provide the ability to control delay at each individual element, near-ideal spatial combing, and beam steering.

In some embodiments, coherent spatial combining from multiple elements of an array of impulse radiators is provided. The combined signal from elements or impulse radiators may provide minimal jitter (e.g. 230 fsec or less), a short pulse-width (e.g. 14 psec or less), and/or a high EIRP (e.g. 17 dBm). Each array element may be equipped with a digitally-programmable delay. In some embodiments, the chip is implemented in a 65 nm bulk CMOS process.

In some embodiments, each array element is equipped with an on-chip programmable precision delay block. Further, this digital-to-impulse architecture is compatible with a CMOS process. In some embodiments, the array elements are synchronized with each-other with timing accuracy of equal to or better than 100 fsec.

In some embodiments, arrays with programmable delay elements can perform beam-steering by controlling the delay provided by the delay elements. Notably, this array has a large radiated power. Further, this array has a large Effective Isotropic Radiated Power (EIPR). The EIRP of the array is about $N^2$ times larger than that of a single element, where N is the number of elements in an array.

The foregoing has outlined rather broadly various features of the present disclosure in order that the detailed description that follows may be better understood. Additional features and advantages of the disclosure will be described hereinafter.

BRIEF DESCRIPTION OF THE DRAWINGS

For a more complete understanding of the present disclosure, and the advantages thereof, reference is now made to the following descriptions to be taken in conjunction with the accompanying drawings describing specific embodiments of the disclosure, wherein:

FIG. 19 shows a frequency-domain (FD) measurement setup;

FIGS. 20A-20F respectively show sample frequency components measured at 1.10 THz with 20 dB SNR, 1.08 THz with 22 dB SNR, 0.90 THz with 30 dB SNR, 0.81 THz with 33 dB SNR, 0.75 THz with 40 dB SNR, and 0.60 THz with 40 dB SNR;

DETAILED DESCRIPTION

Figure 1A:
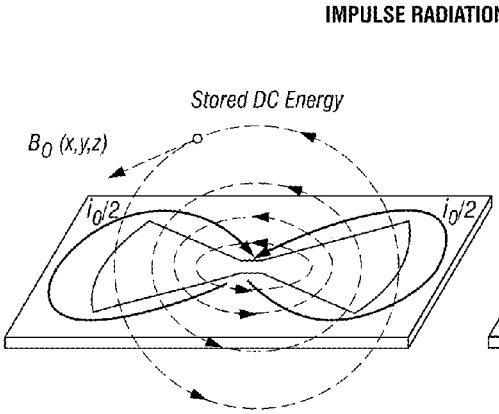
FIGS. 1A-1B show an impulse radiation mechanism, and more particularly, storing a DC magnetic energy in an antenna structure through a circulating current and radiation of an ultra-short impulse are respectively shown.

Refer now to the drawings wherein depicted elements are not necessarily shown to scale and wherein like or similar elements are designated by the same reference numeral through the several views.

Referring to the drawings in general, it will be understood that the illustrations are for the purpose of describing particular implementations of the disclosure and are not intended to be limiting thereto. While most of the terms used herein will be recognizable to those of ordinary skill in the art, it should be understood that when not explicitly defined, terms should be interpreted as adopting a meaning presently accepted by those of ordinary skill in the art.

It is to be understood that both the foregoing general description and the following detailed description are exemplary and explanatory only, and are not restrictive of the invention, as claimed. In this application, the use of the singular includes the plural, the word "a" or "an" means "at least one", and the use of "or" means "and/or", unless specifically stated otherwise. Furthermore, the use of the term "including", as well as other forms, such as "includes" and "included", is not limiting. Also, terms such as "element" or "component" encompass both elements or components comprising one unit and elements or components that comprise more than one unit unless specifically stated otherwise.

Direct digital-to-impulse (D2I) systems and methods are discussed herein. A fully-programmable digital-to-impulse radiator with a programmable delay may be provided. In some embodiments, the impulse radiator may be implemented as an integrated circuit. In some embodiments, the impulse radiator may include a programmable delay, edge-sharpening amplifier, current switch, impulse matcher, and antenna. The programmable delay may be an integrated programmable delay that can shift the timing of a digital trigger. The digital trigger may be fed to the amplifier, switch, and impulse matcher. An antenna coupled to the impulse matcher may then radiate ultra-short impulses. The impulse radiator may be part of an array of impulse radiators. As a nonlimiting example, the array may be a 4×2 impulse radiator array, 4×4 impulse radiator array, or the like. The radiating array may provide the ability to control delay at each individual element, near-ideal spatial combing, and beam steering.

Physics of D2I:

The D2I method of on-chip impulse radiation is inspired by numerous physical phenomena with similar mechanisms. In other words, in any physical system with a stored potential energy, a trigger-based mechanism can be engineered to form a pulse by releasing the stored energy of the system in a rapid manner. Depending on how fast this energy can be released and the degree of nonlinearity of the triggering mechanism, the duration of the energy pulse can be changed. As a simple example, an object attached to a stretched spring is a narrowband $2^{nd}$ order system which will make many oscillations after release. However, in another example, the fast energy-transfer between a free falling stone and water surface creates an almost ideal circular surface-wave impulse. In human body, instantaneous opening of ion channels in a neuron membrane induces an action potential which travels as an impulse through the nervous system.

The magnetic energy stored in an antenna structure having a circulating DC current of $i_0$ is expressed as $$E_{DC} = \iiint_{-\infty}^{\infty} \frac{1}{2\mu(x, y, z)} B_0^2(x, y, z)\,dx\,dy\,dz = \frac{1}{2}\Phi_0 i_0 = \frac{1}{2}L_0 i_0^2, \tag{1}$$

where $\mu(x, y, z)$ is the permeability in space, $B_0(x, y, z)$ is the stored DC magnetic flux density, and $\Phi_0$ is the stored magnetic flux, and $L_0$ is the inductance of the antenna at DC. The real part of the antenna impedance at DC is negligible and only plays a dissipative role without changing the stored DC energy. The stored energy can also be written in terms of the reactive part of the antenna impedance, $X_{ant}$:

$$E_{DC} = \frac{1}{2}L_0 i_0^2 = \left.\frac{X_{ant} i_0^2}{2\omega}\right|_{\omega\to 0}. \tag{2}$$

From (1), it can be understood that circulating a larger DC current and having a higher inductance for the antenna stores a higher magnetic energy. As a nonlimiting example, for a 100 mA current, an example of the antenna discussed herein had stored magnetic energy of 540 fJ (L=108 pH).

Figure 1B:
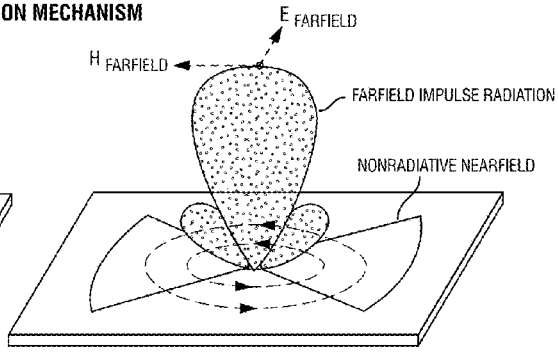
Figure 1C:
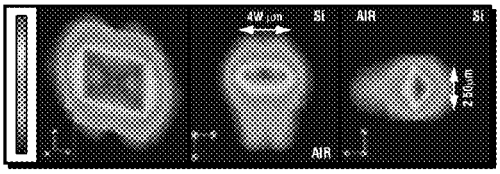
FIGS. 1C-1D respectively show stored magnetic energy in a slot bow-tie antenna and radiated E-field.
Figure 1D:
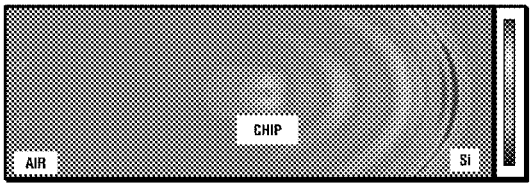
Figure 1E:
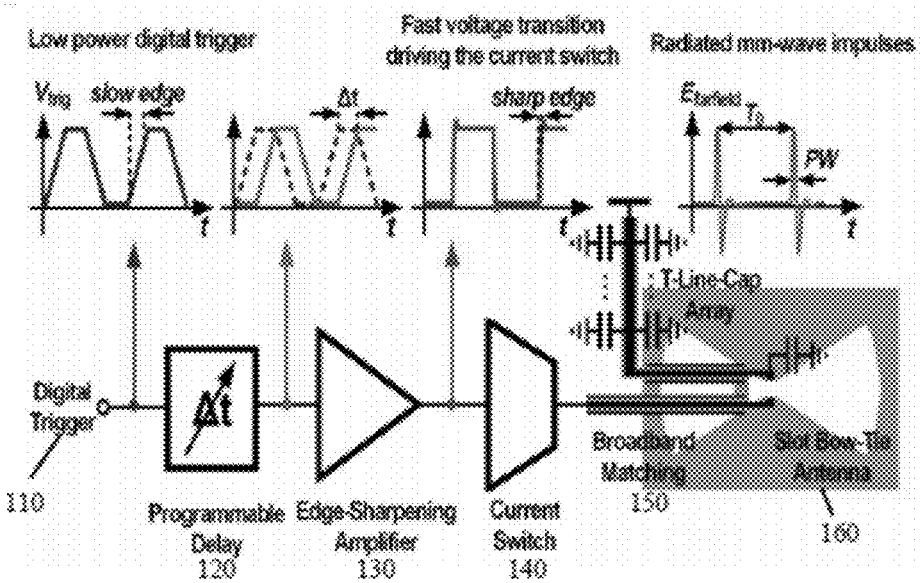
FIG. 1E shows a system-level block diagram of an individual impulse radiator.

The signal generation and radiation mechanism in a D2I architecture based on such concepts is shown in FIGS. 1A-1E. FIG. 1E shows a system-level block diagram of an impulse radiator. The method of impulse radiation begins with storing a DC magnetic energy in an antenna structure through a circulating current (FIG. 1A). Subsequently, by disconnecting the stored current using a fast current switch through a broadband impulse-matching network, an ultra-short impulse is radiated (FIG. 1B). The impulse antenna requires a broadband flat gain and a linear phase, i.e., a constant group delay. FIGS. 1C-1D also shows the stored magnetic energy in the slot bow-tie antenna and the radiated E-field. The stored magnetic energy is converted to an ultra-short electromagnetic impulse radiation and depicts the spatially confined stored energy in slot bow-tie geometry which enables scalable dense arrays and fast conversion of magnetic energy into radiation. Returning to FIG. 1E, the process of releasing the stored magnetic energy into a radiated impulse is done with a digital trigger 110, programmable delay 120, edge-sharpening amplifier 130, a current switch 140, an antenna 160 (e.g. broadband, phase-linear), and an intermediate impulse matching network 150 that minimizes ringing while maximizing the peak amplitude of radiation. This mechanism also works when performed reversely, by starting to store a magnetic energy. A digital trigger 110 is received at an input of a pulse radiator, which has a trigger path separated from a data signal path. The programmable delay 120 controls the delay of the digital trigger, which may be delayed a predetermined amount of time, such as for beam steering. The edges of the digital trigger may be sharpened by the edge-sharpening amplifier 130, and the trigger signal is outputted to the current switch 140. While edge-sharpening amplifier 130 is illustrated after the delay 120, in some embodiments, this amplifier may be provided before the delay and the trigger signal may be outputted to the delay. The current switch 140 controls a current applied to an antenna 160. As such, the current switch 140 may provide the circulating current to the antenna 160 so it may store energy, and may subsequently disconnect from the antenna to allow the energy to be released as the radiated impulse. The current switch 140 may operate in accordance with the digital trigger 110 to allow the impulse outputted in accordance with the desired amount of delay. The current switch 140 outputs to an impulse matcher 150 that outputs the trigger signal to the antenna, the pulse matcher may reduce ringing, maximizes an amplitude of the impulses, or minimizes a pulse width of the impulses.

Bandwidth, Jitter, Efficiency, and Scalability of D2I:

Unlike oscillator-based architectures, in D2I, the bandwidth of the radiated pulse is not limited to the on/off transient or the tuning range of a central VCO. The deeply nonlinear switching mechanism in this architecture generates numerous harmonics from GHz to THz frequencies. Having a high-power, broadband frequency-comb source is critical to provide high SNR at the receiver in imaging and spectroscopy applications. The D2I architecture radiates an impulse train in time domain. Considering x(t) as the time-domain signal of a single impulse, the time-domain impulse train can be written as, $$y(t) = x(t) * \sum_{k=-\infty}^{\infty} \delta(t - kT) = \sum_{k=-\infty}^{\infty} x(t - kT), \tag{3}$$

where T is the time period of the impulse train signal. By taking the Fourier transform of y(t) we will have, $$Y(f) = \frac{1}{T} X(f) \sum_{k=-\infty}^{\infty} \delta\left(f - k\frac{1}{T}\right), \tag{4}$$

in which X(f) is the Fourier transform of a single impulse signal. Thus, the frequency spectrum of an impulse train is a sampled version of the frequency spectrum of a single impulse with steps of 1/T. To perform spectroscopy, T can be controlled to sweep the whole spectrum.

In an oscillator-based pulse radiator, VCO and PLL phase noise directly translate into the jitter of the generated pulses. In D2I topology, by direct translation of the edge of an ultra-stable digital trigger source into a radiated impulse, the starting time of the impulse radiation is locked to the edge of the input trigger and this results in an ultra-high frequency stability for the harmonic frequency tones. In other words, implementation of a PLL is not required and jitter of the radiation is not affected by phase-noise performance of the PLL, hence the added jitter in D2I from the input trigger up to the radiated signal is significantly lower.

In an oscillator-less topology, removing the VCO increases power efficiency by withdrawing the constant power consumption of VCO and PLL. In D2I, the current switch stage can be only turned on shortly before the edge of the trigger and does not have to stay on. In addition, removing the PLL increases power efficiency of the chip. Similar discussion can also be made regarding the chip area in which the D2I architecture achieves a high scalability by being needless of area consuming building blocks such as VCO, PLL, and DLL, used in oscillator-based pulse work.

Broadband, Highly-Directive Beamsteering with D2I to Avoid Wireless Interference without Limiting Bandwidth:

Today, applications such as radar, imaging, spectroscopy, and high-speed wireless communication have a shared demand of low-cost, efficient, and broadband transceivers in silicon. As a generic high-power and broadband transmitter, a D2I radiator can fulfill the transmitter requirement in these systems. This radiator has a high frequency stability (2 Hz at 1.1 THz) and a high efficiency. In addition, it consumes a small area to empower scalability and enable building widely-spaced and on-chip arrays. Broadband picosecond impulse systems can be used to build point-to-point wireless links with data rates of several 100 Gbps. Unlike conventional oscillator-based communication systems, impulse transceivers can employ directional coding for secure communication based on the ability to distinguish impulses from each other in time. In addition, arrays of impulse radiators can perform time interleave of coherent groups of impulse radiators and dynamic beamforming to significantly increase the SNR at the receiver and relax receiver requirements at Tbps data rates.

The first wireless communication in history was performed using spark gap pulse transmitters. They were used for long range wireless transmission and the capacity of the channels were limited because of interference. Today, wireless systems use Frequency Division Multiplexing (FDM) to avoid wireless interference. However, there are certain challenges associated with FDM: First, system efficiency is usually sacrificed to provide more room for the linearity of systems to avoid out-of-band interferers and blockers. Second, a wholesome of complex processing is required for small wireless bandwidths associated to applications or users. Third, the overall efficiency of current communication systems is degraded from lacking dynamic beamforming that results in omnidirectional radiation and wasting a large portion of the power.

Figure 2:
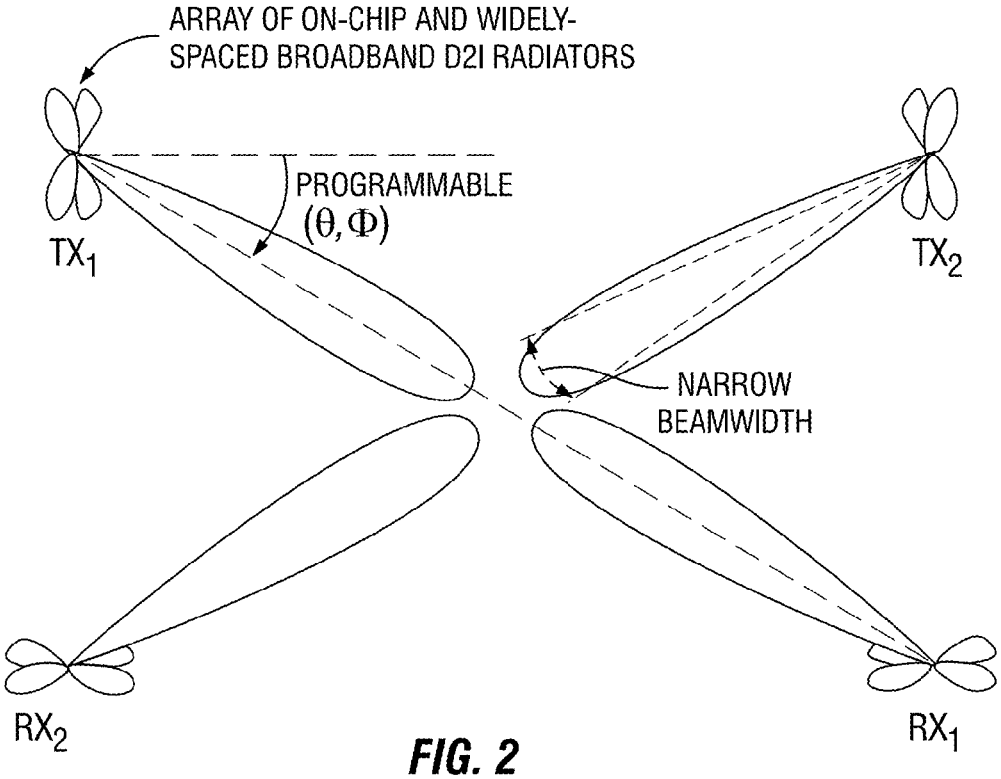
FIG. 2 illustrates highly-directive beamforming to avoid interference.

A simple broadband impulse radiator is introduced as a key element for building widely-spaced and on-chip arrays with increased aperture size. Unlike the broadband nature of impulse, a novel type of solution is introduced to avoid interference between broadband THz impulse wireless links that is different from the traditional FDM. FIG. 2 illustrates the idea of highly-directive beamforming to avoid interference. As shown, the transmitters can provide a narrow beamwidth signal in a desired direction towards corresponding receivers utilizing a programmable delay. In order to achieve this, a novel beamforming method is presented to perform beam-steering of broadband impulse radiation far beyond the limits of conventional, narrowband phased array systems. This beamforming method is introduced later in this section.

Trigger-Based Beamforming Architecture:

Different beam-steering methods have been contemplated for phased-array architectures. In the first method, the time delay is introduced in the signal path by using tunable transmission-lines based on non-linear varactors. The main disadvantage of the signal-path delay elements are their nonlinearity and signal-dependent behavior. This is because the waveform of the information signal varies with time, which results in an undesired waveform-dependent delay. In the second method, delay generation is performed by phase shifting the LO signal at the LO-path. This method is inherently narrow—and and only works at a single frequency. In the third method, the time delay is generated in baseband using a digital processor. In this method, a large number of complex digital processors are needed that increase the complexity of the system.

Figure 3A:
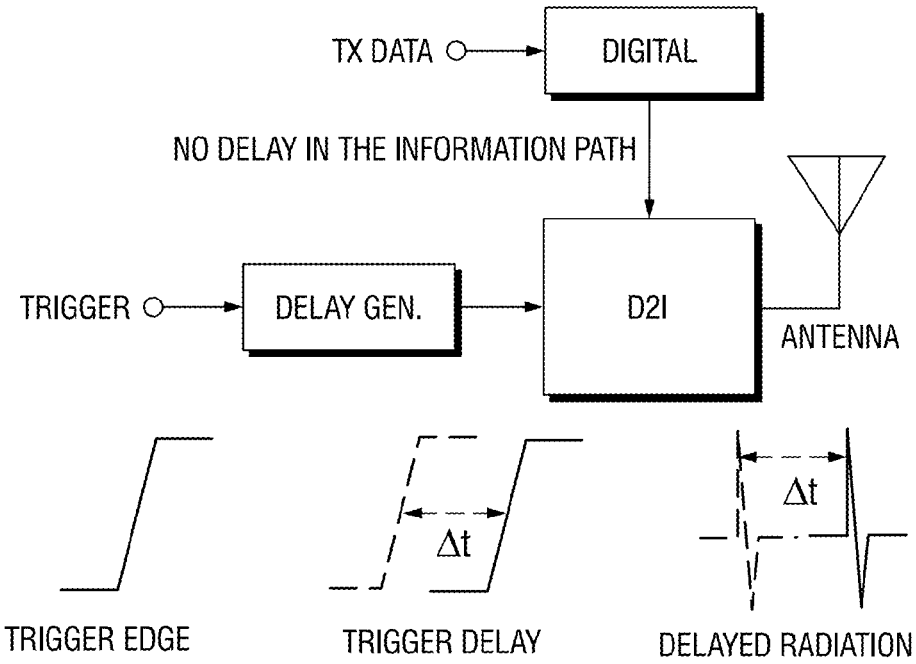
FIGS. 3A-3C respectively show a trigger-based beamforming architecture, beamsteering using the architecture, and a detailed circuit of a programmable delay generator.
Figure 3B:
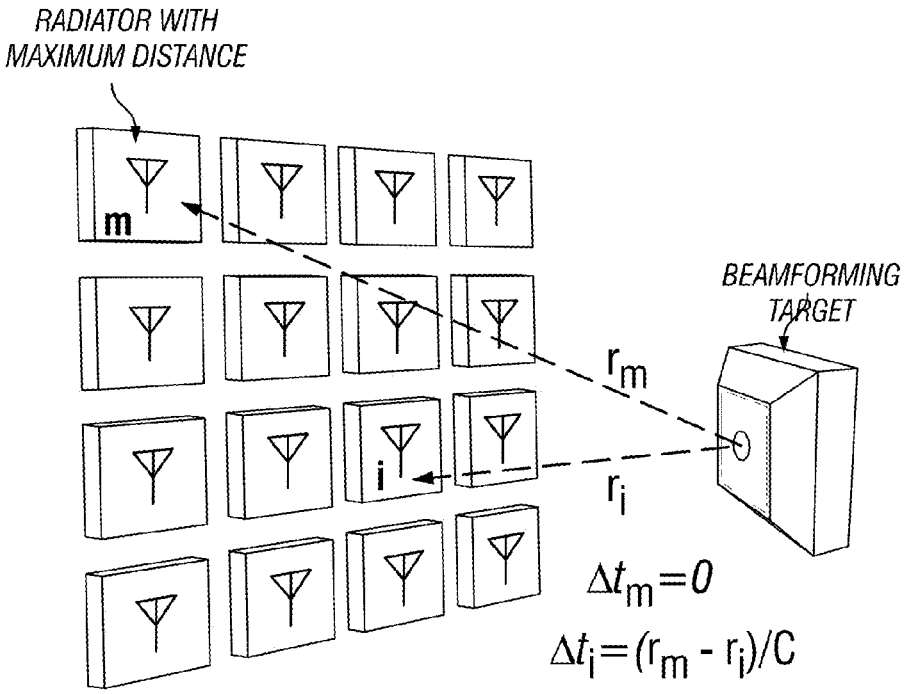

In the D2I architecture, the information signal is stored at the location of the radiator. By delaying the trigger signal, the radiated pulse is delayed. As the trigger signal controls an output timing of the impulse, in some embodiments, this delay may be achieved by controlling timing of a current applied to an antenna in accordance with the trigger signal. Additionally, the information signal or data signal controls the amplitude of the impulse. As such, in some embodiments, the amplitude of the current applied to the antenna may be controlled in accordance with the data signal. Since the delay path is separated from the signal path (information path), the information content of the signal does not affect the generated delay. In addition, since the time-domain waveform of the trigger signal is always constant and does depend on the information signal (FIG. 3A), the non-linear delay generator is only used to delay the trigger signal. This method enables broadband delay of the radiated signal with accuracy of close to 150 fsec, which is limited by the timing jitter of the system. Unlike LO-phase shifting schemes, due to the broadband nature of the delay mechanism in D2I, it is possible to build a high-directive radiating array, where all the frequency contents of the signal are precisely steered together. FIGS. 3A-3B shows the trigger-based beamforming architecture. As shown in FIG. 3A, the trigger is provided to a delay generator, which delays the trigger edge by $\Delta t$, and the outputted trigger is provided to the D2I circuitry. The digital-to-impulse (D2I) circuit coupled to the trigger input and data input controls the current applied to the antenna to output impulses. In some embodiments, the D2I circuit controls timing of a current applied to an antenna in accordance with the trigger signal, thereby controlling an output timing of an impulse. Further, the D2I circuit controls amplitude of the current applied to the antenna in accordance with the data signal, thereby controlling the amplitude of the impulse. The TX data (i.e. information signal or data signal) is provided to a digital memory next to the radiator via a different pathway, and the TX data outputs to the D2I circuitry immediately or almost immediately. The D2I circuitry outputs the TX data to the antenna in accordance with the trigger provided by the delay generator. As noted previously above, the trigger signal controls output of the impulse, which is amplitude modulated in accordance with the TX data. When the trigger signal arrives, the data (information bits) are radiated. The data can modulate the amplitude of the radiated pulse by controlling the bias voltages in the impulse radiator (e.g. $V_2$, $V_3$, or $V_{cc}$ in FIGS. 11A-11B). With the precise trigger signal timing control provided, an array of impulse radiators with the aforementioned delay generator can provide beam-steering and spatial combining. In FIG. 3B, two radiators from an array can focus on a beamforming target by controlling the respective delays of the radiated impulses. A first impulse radiator (m) may output an impulse ($r_m$) at a desired time ($\Delta t_m=0$), such as in the manner discussed above. A second impulse radiator (i) may output a second impulse ($r_i$) at a second desired time ($\Delta t_i=(r_m-r_i)/c$). From this timing formula, it is apparent that the timing second impulse accounts for the difference in distance between the two radiators and target location, and delays the respective impulses so they will arrive at the target location approximately simultaneously. While the example shows two impulse radiators outputting an impulse, any number of radiators may output impulses as desired. For beam-steering or spatial combining, at least one other impulse is outputted from at least another impulse radiator from the array of impulse radiators (or at least two impulses total), where the desired delay set for this other impulse accounts for the difference in distance to the target location for beam steering or spatial combining. This method of time-domain trigger-based beamforming enables broadband beamforming of on-chip and widely-spaced arrays of impulse radiators.

Figure 3C:
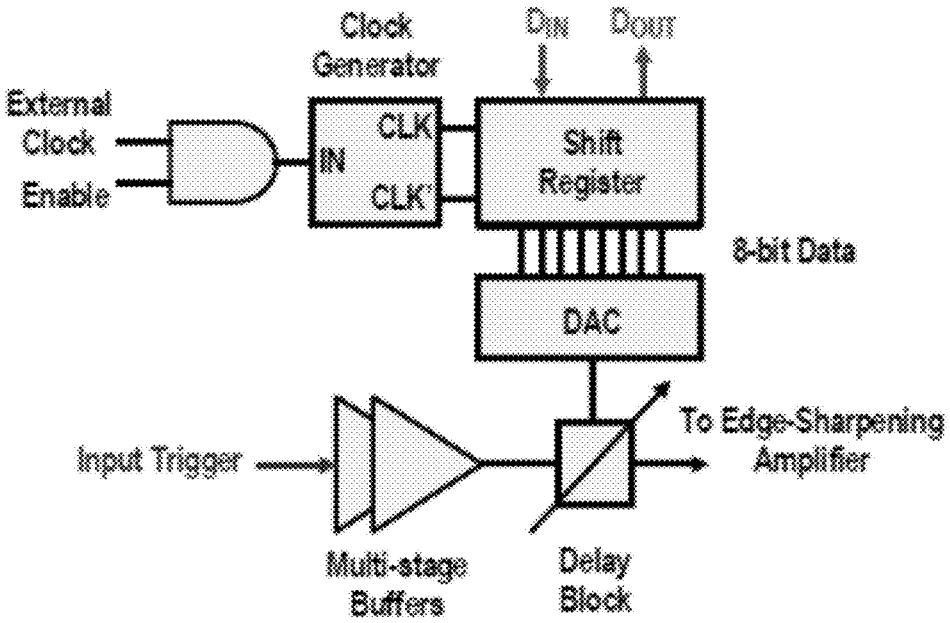

In the proposed topology, each individual radiator can operate in two modes. In the first mode a positive impulse is radiated, which is locked to the rising edge of the digital trigger, and in the second mode, a negative impulse is radiated and locked to the falling edge of the digital trigger. FIG. 3C shows a detailed schematic of a programmable delay generator used at each element. In some embodiments, the delay of the trigger signal at each element may be controlled using an 8-bit serial data, which is different than the information signal or TX data. The input trigger may be provided to multi-stage buffers that output to a delay block. An external clock and enable signal may be provide to an AND gate, which outputs to a clock generator. The clock generator outputs CLK and CLK' signals to a shift register. The shift register receives $D_{in}$ and $D_{out}$ and outputs 8-bit data or a delay control signal to the DAC, which is coupled to the delay block. The digital delay control is achieved by adjusting the supply voltage of a series of NOT stages through the on-chip DAC. A high supply voltage results in fast rise/fall times, which leads to a smaller delay. By lowering the supply voltage, the rise/fall times increase and the value of the delay becomes larger. The DAC outputs the delay control signal to the delay block so the received trigger can be delayed by a desired amount according to the control signal. The precise control provided by this delay generator allows for beam steering and coherent combining of impulses radiated from the array of impulse radiators.

Figure 4A:
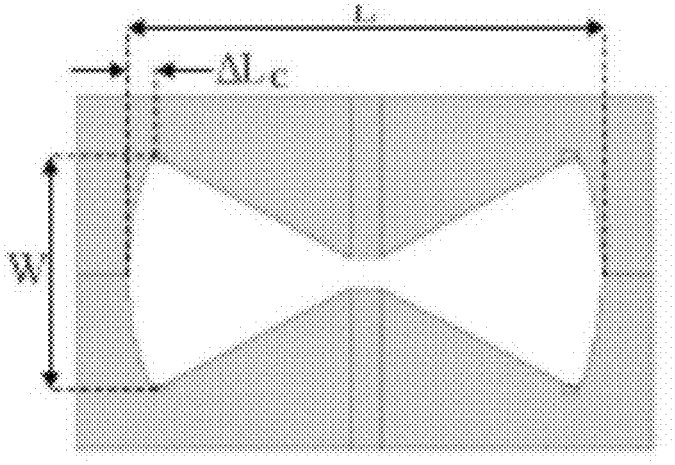
FIGS. 4A-4C respectively show a slot bow-tie antenna, an enlarged view of the antenna and circuit architecture, and the antenna and circuit architecture on a silicon lens.

Circuit Architecture: On-Chip Impulse Antenna:

In order to attain a large bandwidth, high scalability, and high efficiency, a D2I system is implemented using on-chip antennas. A large bandwidth is ensured by avoiding narrowband, costly off-chip component interconnects. In addition, an on-chip antenna structure maximizes system scalability and efficiency. An on-chip slot bow-tie antenna is utilized as shown in FIG. 4A. The slot bow-tie antenna's near and far field responses, antenna properties, and second order effects were studied. One of the important challenges in designing an integrated impulse antenna is the effect of reflections from the boundary between the chip silicon substrate and the medium beneath the substrate. This effect degrades antenna efficiency and bandwidth, and introduces substantial nonlinearity in the phase of the antenna. Having a broadband, phase-linear radiation requires avoiding image antennas, which means an antenna on ground-plane or other chip-on-board assemblies with image antennas cannot be used. In order to avoid the effects of the substrate on impulse radiation, some embodiments may utilize a hemispherical high resistivity silicon lens is attached under the chip to mimic a semi-infinite silicon substrate for the antenna (e.g. FIG. 4C). The silicon lens increases the radiation efficiency by minimizing the loss of substrate modes and maximizes the bandwidth by avoiding substrate reflections.

Slot Bow-Tie Impulse Antenna:

To minimize the pulse-width of the radiated impulse, the antenna needs to have a broadband impulse response with linear phase. In addition, a D2I radiator needs to store a DC current through an antenna which requires the use of a slot-type antenna for this architecture. A slot dipole has a narrowband gain and nonlinear phase and cannot be used as an impulse antenna. Certain types of broadband antennas such as log-periodic dipole arrays exist that consume a large area and suffer from phase nonlinearity causing pulse dispersion. A slot bow-tie antenna is used to radiate impulses. FIG. 4A shows the geometry of the slot bow-tie antenna. The slot bow-tie antenna has two triangularly-shaped regions where a point of each triangle intersects each other to form a mirror image. Further, the ends of the two triangles further away from each other may be curved. The combined length of the two intersection triangles may be L, and the width of a curved portion of the triangles may be W. Additionally, a gap ΔLc may present between a point along the curved end that is further away from the interesting tips and the edges of the triangle where the curved end begins.

Figure 4B:
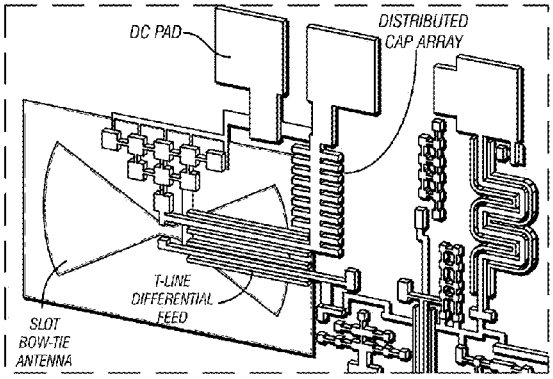
Figure 4C:
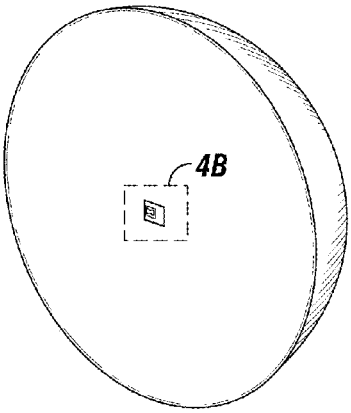

FIGS. 4B-4C respectively show an enlarged view of the antenna and circuit architecture, and the antenna and circuit architecture on a silicon lens. The antenna may be realized by a copper metal layer (e.g. 200 μm) on a lossy silicon substrate on top of a high-resistivity silicon lens. THz pulse radiation is coupled to a silicon lens. The lens may have a diameter of 12.5 mm in some embodiments.

Figure 4D:
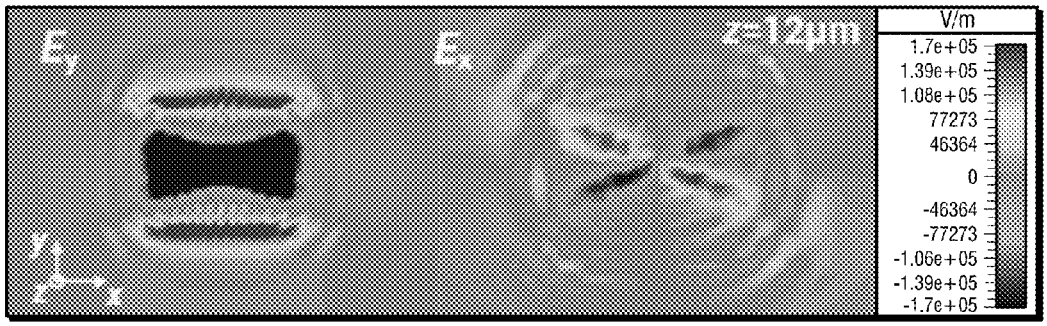
FIG. 4D shows electric field in x and y directions at 12 μm higher than the antenna plane.
Figure 5A:
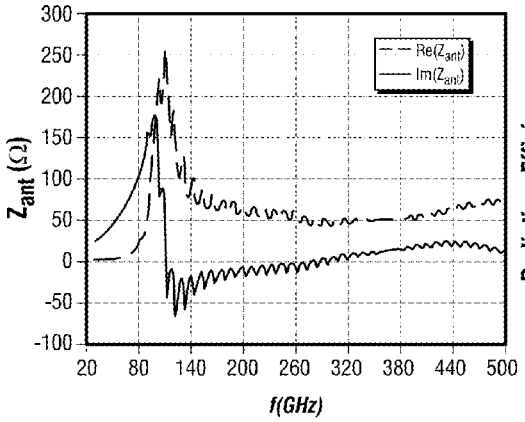
FIGS. 5A-5B respectively show impedance and radiation efficiency v. frequency (GHz) of the slot bow-tie antenna.
Figure 5B:
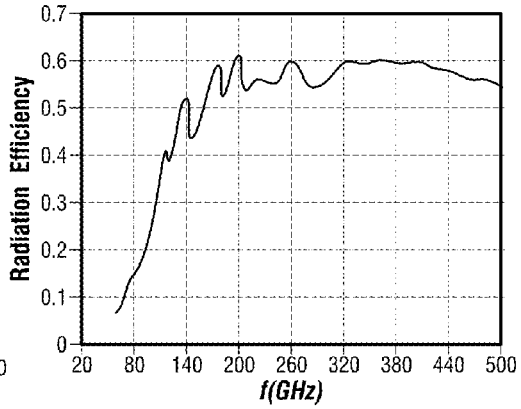
Figure 6A:
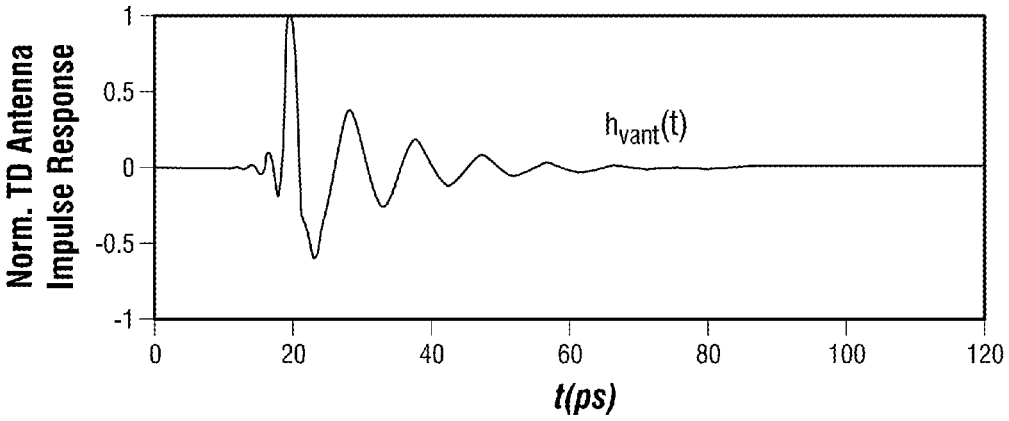
FIGS. 6A-6B and 7A-7B respectively show near- and far-field impulse responses of a system modeled with LTI transfer functions of orders 2 and 4.
Figure 6B:
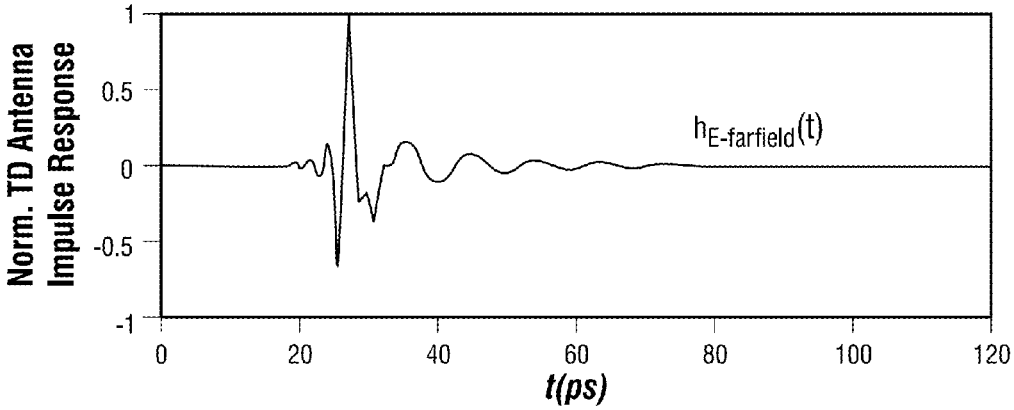
Figure 7A:
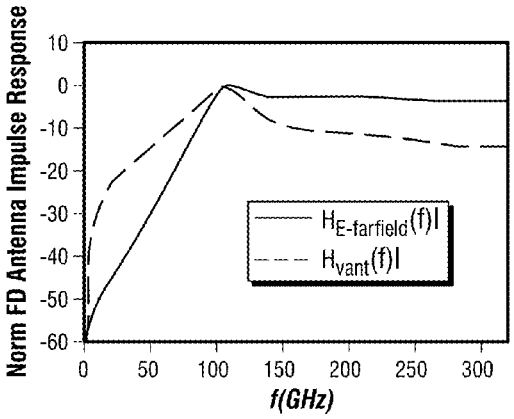
Figure 7B:
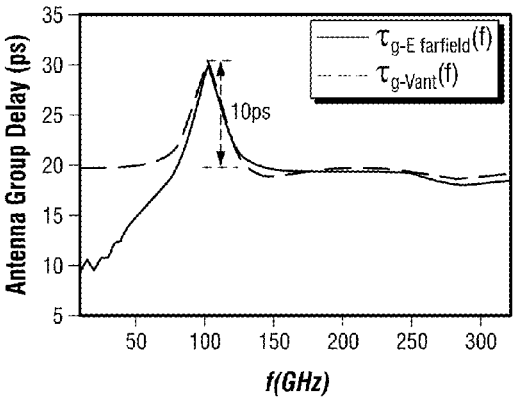

Two shielded microstrip transmission lines are used as a differential pair of feeds for the antenna. Near-field of the antenna is simulated to locate the suitable spots for the feed structure. Electric field in x and y directions at 12 μm higher than the antenna plane is plotted in FIG. 4D, that shows the transmission lines can be placed along the x-direction at the center of the antenna, where $E_x=0$. The width of the horizontal feeds is minimized to have the least effect on the nearby E-field. In addition, circuit components are placed distant from the corners of the triangles where E-field is maximum. FIGS. 5A-5B respectively show the impedance and radiation efficiency v. frequency (GHz) of the slot bow-tie antenna. The ringing effect in impedance and radiation efficiency is caused by the internal reflections in the silicon lens.

FIG. 4B shows the designed slot bow-tie impulse antenna with its feeds and substrate. The corners of the two triangles in the slot bow-tie are curved to improve the impulse response. A distributed array of high-frequency capacitors is used along the transmission line feed of the antenna to achieve broadband termination. Two transmission lines carry the circulating current through the slot bow-tie antenna.

Near- and Far-Field Impulse Response:

The slot bow-tie antenna can be modeled as a single-input single-output system which has an input voltage or current and an output electromagnetic field in the space. Thus, the antenna will be treated as a linear time-invariant (LTI) system with both near and far fields as for the outputs of this system. The far-field response is important because of the applications that the impulse radiator is used in. The near field response directly affects the active core circuit and switching performance of transistors, and the nearby radiating elements in case of an array of D2I radiators.

Figure 8:
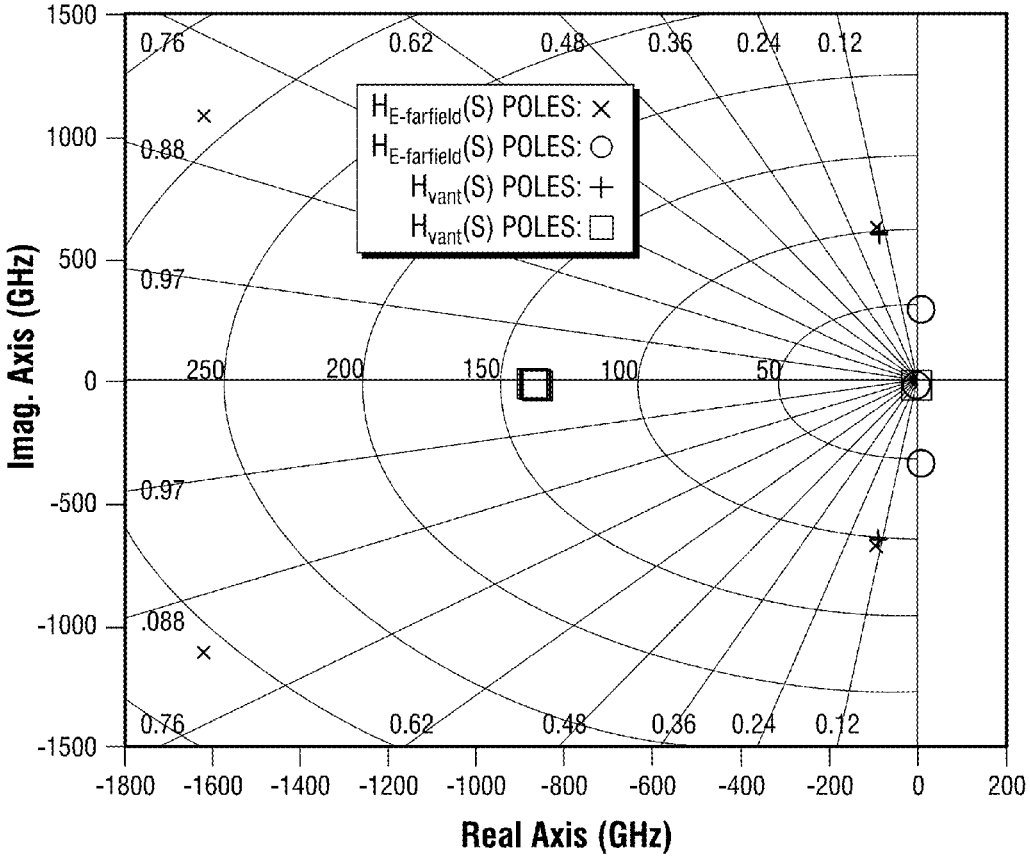
FIG. 8 show pole-zero maps of a transfer functions.

Assuming a semi-infinite silicon substrate under the chip and 90% accuracy over a range of 0 to 320 GHz, the voltage and far-field E-field responses of the antenna are simulated and shown. The near- and far-field impulse responses of this system are modeled with LTI transfer functions of orders 2 and 4, respectively, are shown in FIGS. 6A-6B and 7A-7B, and the pole-zero maps of the transfer functions are shown in FIG. 8. Comparing the magnitude and group delay of the responses it is shown that the far field response has a larger bandwidth and ringing effects are more dominant in the near-field. Therefore, the oscillatory behavior at the first resonance frequency is non-radiative.

Figure 9:
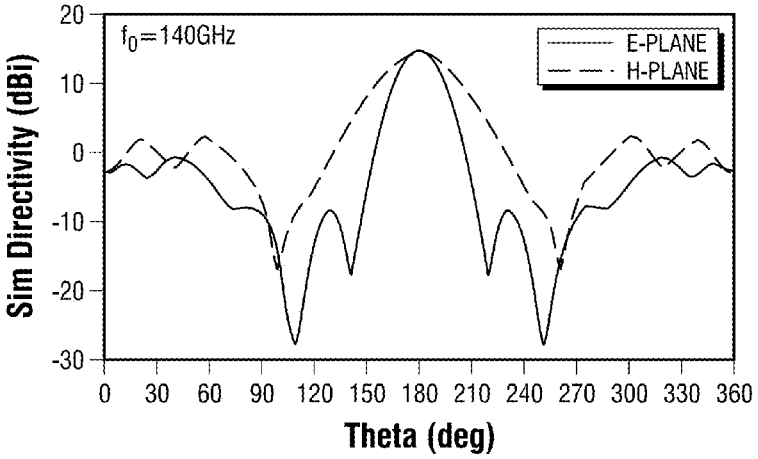
FIG. 9 plots the E- and H-field far-field patterns at $f_0$=140 GHz.
Figure 10A:
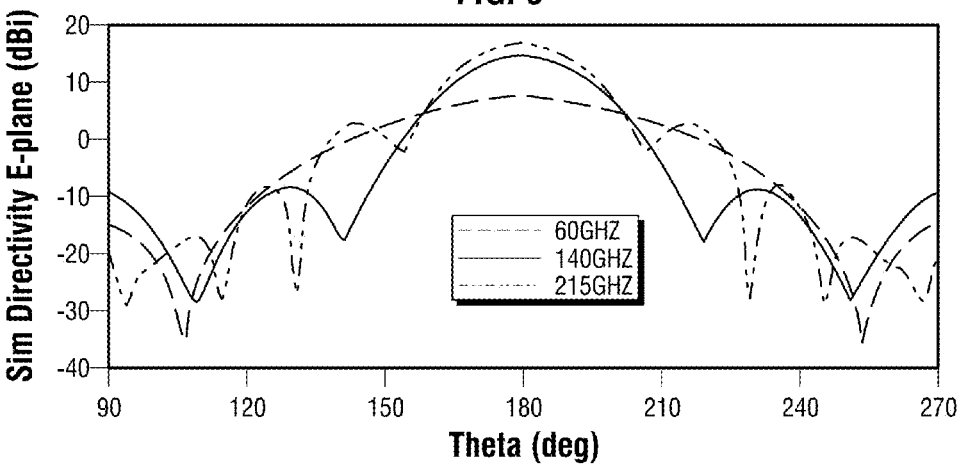
FIGS. 10A-10D respectively show simulated directivity E-plane and E-field patterns at $f_0$,$f_{-3dB,1}$=60 GHz, and $f_{-3dB,2}$=215 GHz.
Figure 10B:
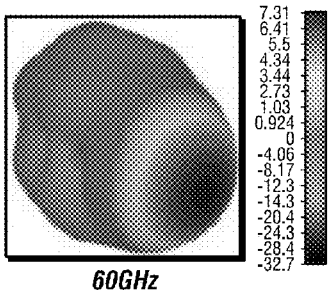
Figure 10C:
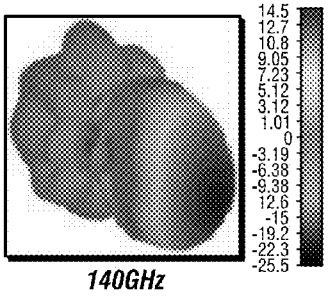
Figure 10D:
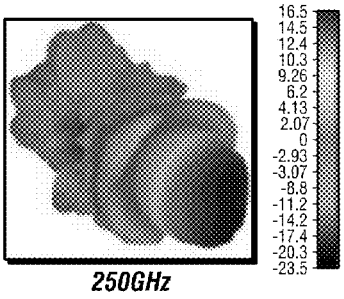

The radiation pattern of the impulse antenna is simulated by realizing the silicon lens on the back of the chip. FIG. 9 plots the E- and H-field far-field patterns at $f_0$=140 GHz, which is the center frequency of the pulse measured in the section below discussing Prototype Characterization in Time and Frequency Domain. A comparison between the simulated E-field pattern at $f_0$, $f_{-3dB,1}$=60 GHz, and $f_{-3dB,2}$=215 GHz (based on measurement) is shown in FIGS. 10A-10D.

Figure 11A:
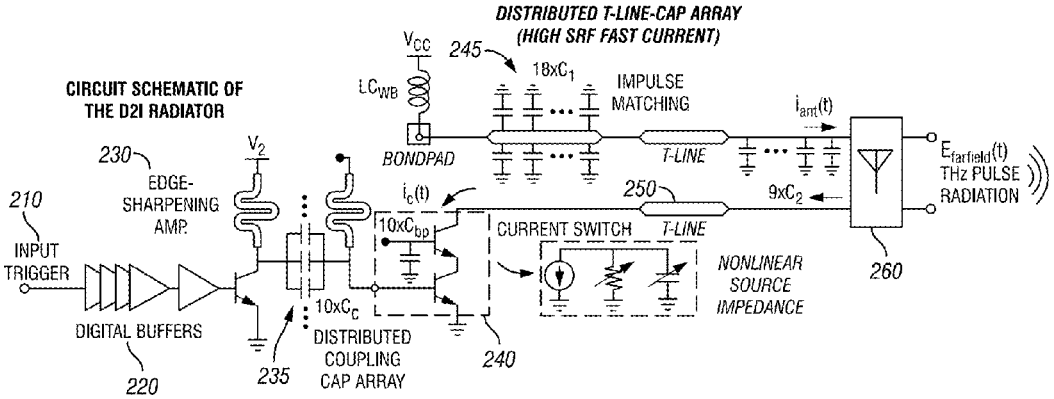
FIGS. 11A-11B show detailed circuit architectures of THz impulse radiators.
Figure 11B:
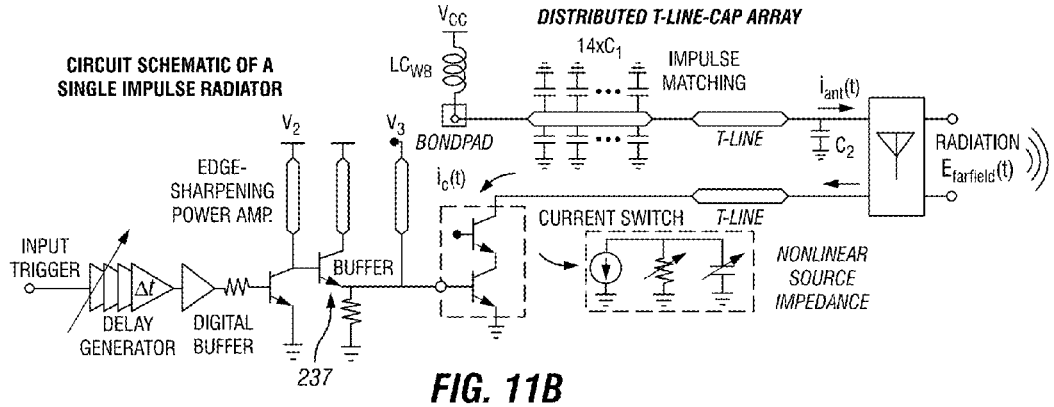

Active Core Circuit:

FIGS. 11A-11B show detailed D2I circuit architectures of the THz impulse radiators that can radiate impulse of 1 THz or greater. A low-power digital trigger with a short rise time (e.g. 150 ps) is fed to the input of the chip. A set of inverter stage buffers or programmable delay 220 receive the inputted digital trigger 210 to delay and/or sharpen its rise time (e.g. 30 ps). Following the digital buffers 220, an edge-sharpening amplifier 230 is designed that employs inductive peaking to further sharpen the rise time, such as to less than 10 ps. The resulting signal has a large amplitude and is coupled to a current switch 240 that is made with a cascode pair of bipolar transistors. An array of distributed capacitors 235 is used to couple the output of the edge-sharpening amplifier 230 to the current switch 240. These capacitors 235 decouple DC biases of $V_2$ and $V_3$ so a more optimum biasing voltage for each transistor can be applied. In other embodiments, the capacitors 235 may be substituted with a buffer 237 as shown in FIG. 11B. It shall be understood that the components of FIG. 11B that are the same as in FIG. 11A operate in the same manner. Capacitor arrays 245 are also used at the biasing nodes to provide broadband terminations. As the current switch outputs to the antenna, the current switch controls the timing of the current applied to the antenna. The performance of the current-switch 240 is observed using two parameters: switching speed and change in current. These parameters determine the pulse-width and the peak power of the radiated THz impulse. The current switch is biased at a deeply nonlinear region and generates pulses with a low Full Width at Half Maximum (FWHM), e.g. less than 2 ps. The effect of current switch input biasing and supply voltage on the radiated pulse is studied in further discussion below.

In this architecture, a cascode current-switch is favored as the current-switch 240 over a single bipolar switch because of the following reasons: First, the cascode pair has a larger bandwidth thus a faster rise and fall time at the time of switching. Second, the cascode switch minimizes the loading effect on the previous stage by avoiding the miller effect. Third, the output resistance of the casocde switch is much larger than a single transistor, which increases the amplitude of the radiated impulse. An array of transmission line 250 and capacitors are used to provide fast supply current at the time of switching to cancel the resonance of the bond wire. Using smaller capacitors with higher series resonance frequency ensures a higher bandwidth for the switching.

Figure 12:
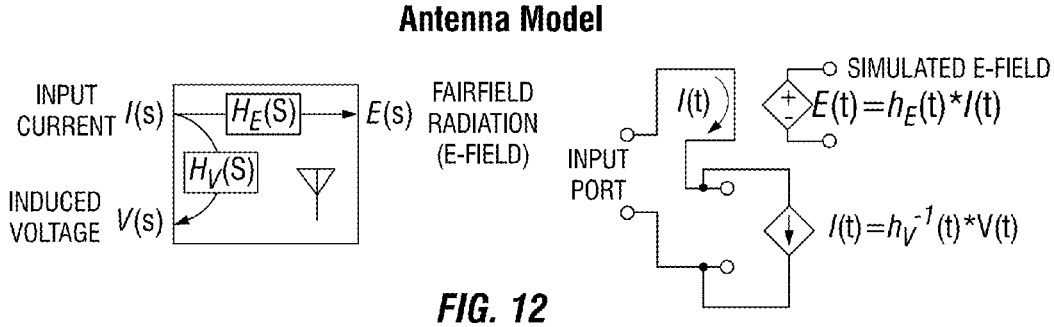
FIG. 12 shows a two port model of the antenna.
Figure 13:
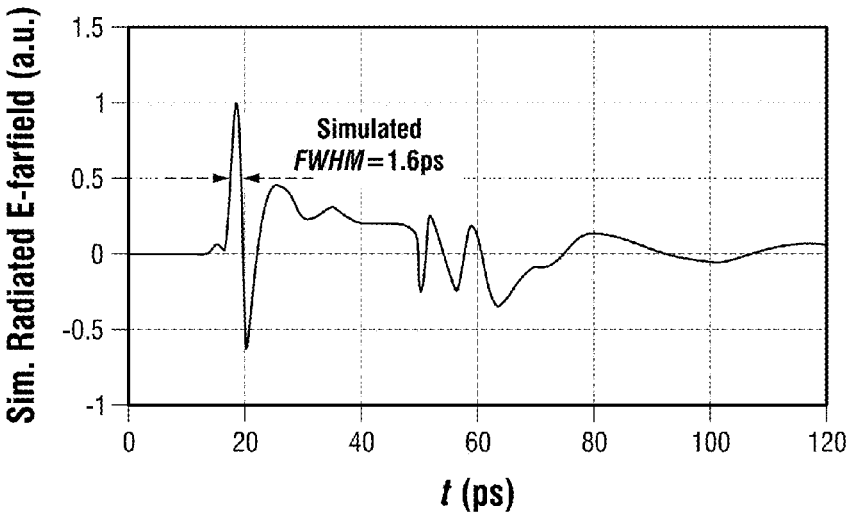
FIG. 13 shows a simulated radiated farfield E-field.

The characteristic impedance of the transmission lines 250 and the unit capacitance of the capacitor arrays are optimized for maximum amplitude of farfield E-field and minimum pulse width with no ringing. Transient simulations are performed to find these optimum parameters for the current-switch stage. The LTI models for antenna's 260 impedance and farfield response are used to create a two port model of the antenna, as shown in FIG. 12. The simulated farfield E-field is shown in FIG. 13.

Prototype Characterization in Time and Frequency Domains: Time-Domain Characterization with a Femtosecond-Laser-Based THz-TDS System:

One of the challenges in measuring a THz pulse waveform in time domain is the receiver that needs to be broadband and phase linear. Pyramidal horn antennas cannot be used to receive impulse radiation due to their nonlinear phase response and their limited bandwidth that has a sharp lower cut-off frequency. In addition, available commercial sampling oscilloscopes have a 3-dB bandwidth limited to below 110 GHz and cannot be used to characterize a THz pulse.

A novel time-domain measurement method is developed to characterize the TD waveform of the radiated THz pulses from an electronic chip using a THz-TDS system with photoconductive antennas (PCA). An Advantest TAS7500TS fsec-laser-based THz sampling system is used to capture the TD signal radiated from the chip. On the receiver side, an Advantest TAS1230 PCA samples the THz waveform. The pulsed-laser repetition rate is 50 MHz. The THz pulse radiator chip's repetition frequency is synchronized with the laser using the synchronization chain designed and shown in FIG. 14. This setup synchronizes a Keysight E8257D signal generator with a 50 MHz electrical signal extracted from the pulsed-laser. The 50 MHz electrical signal is conditioned and its frequency is divided by five and the 10 MHz resulting signal is fed to the 10 MHz reference input of the signal generator.

Figure 15A:
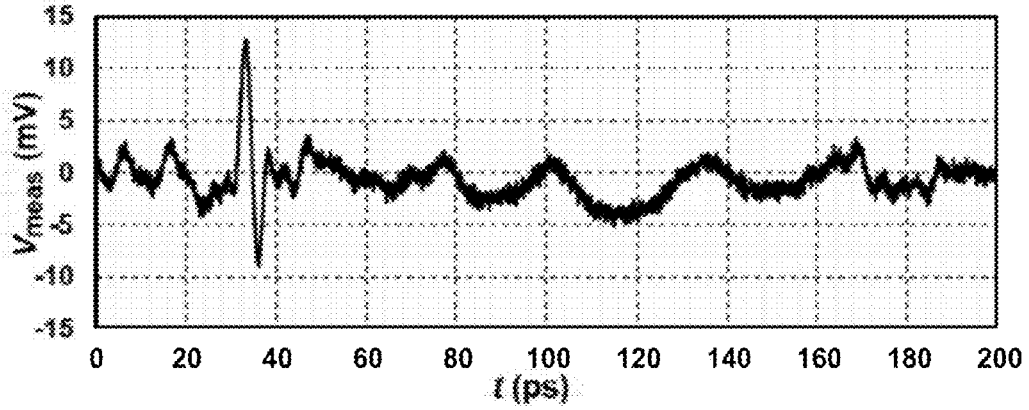
FIGS. 15A-15B respectively show a measured time-domain waveform and smaller time range of the same waveform.
Figure 15B:
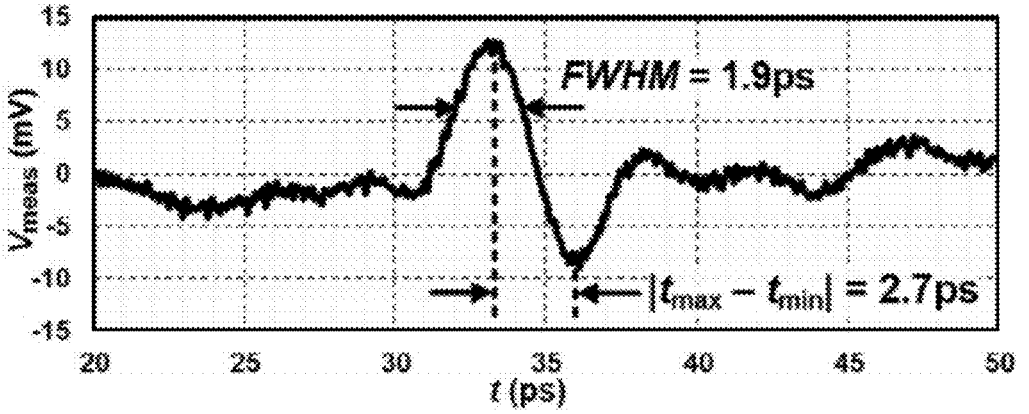
Figure 17A:
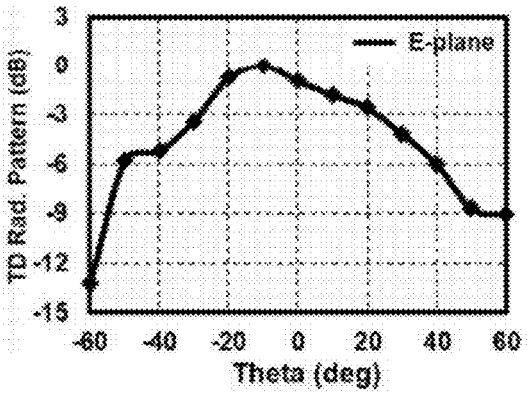
FIGS. 17A-17B respectively show time-domain E-plane radiation pattern of the impulse radiator measured in terms of pulse peak power and pulse width.
Figure 17B:
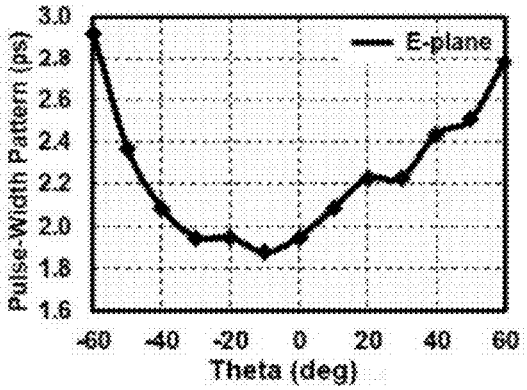
Figure 16:
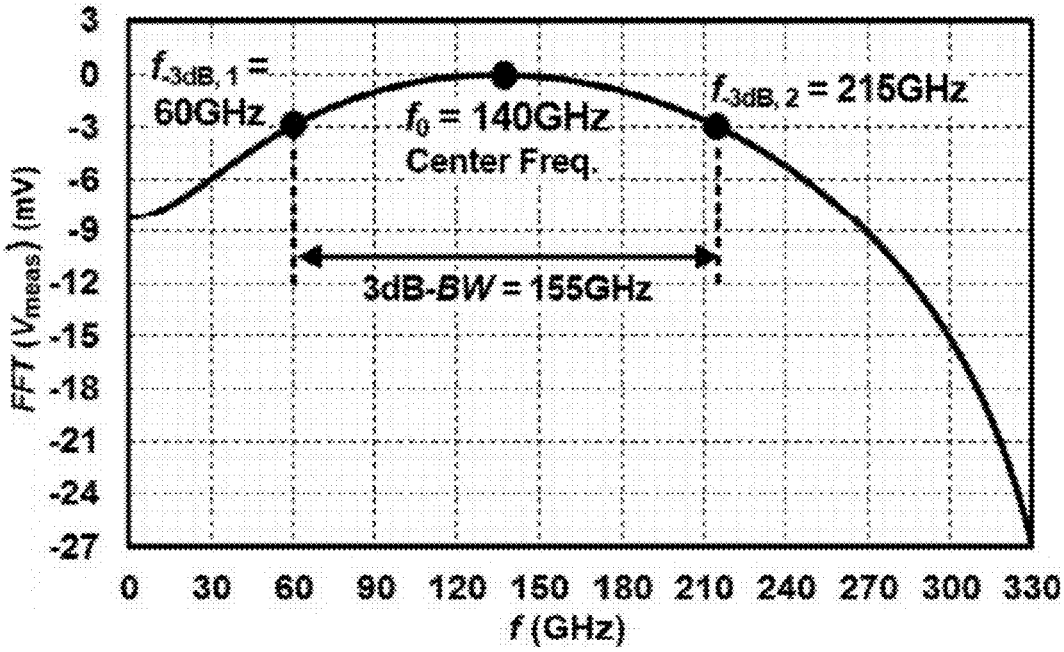
FIG. 16 shows FFT of a time-domain signal.

The measured time-domain waveform is shown in FIGS. 15A-15B. The measured impulse has a FWHM of 1.9 ps with no associated ringing, and a minimum to maximum time of 2.7 ps. The FFT of the time-domain signal is shown in FIG. 16. This frequency spectrum shows a center frequency of 140 GHz and a 3-dB bandwidth of 155 GHz, which translates into a 3-dB fractional bandwidth of 111%. The time-domain E-plane radiation pattern of the impulse radiator is measured in terms of pulse peak power and pulse width, and is shown respectively in FIGS. 17A-17B. Based on this characterization, the FWHM of the radiated impulse changes from 1.9 ps at 0° elevation angle, to 2.8 ps at the elevation angle of 60°. The FWHM of the pulse is 2.2 ps at 30°.

Figure 18:
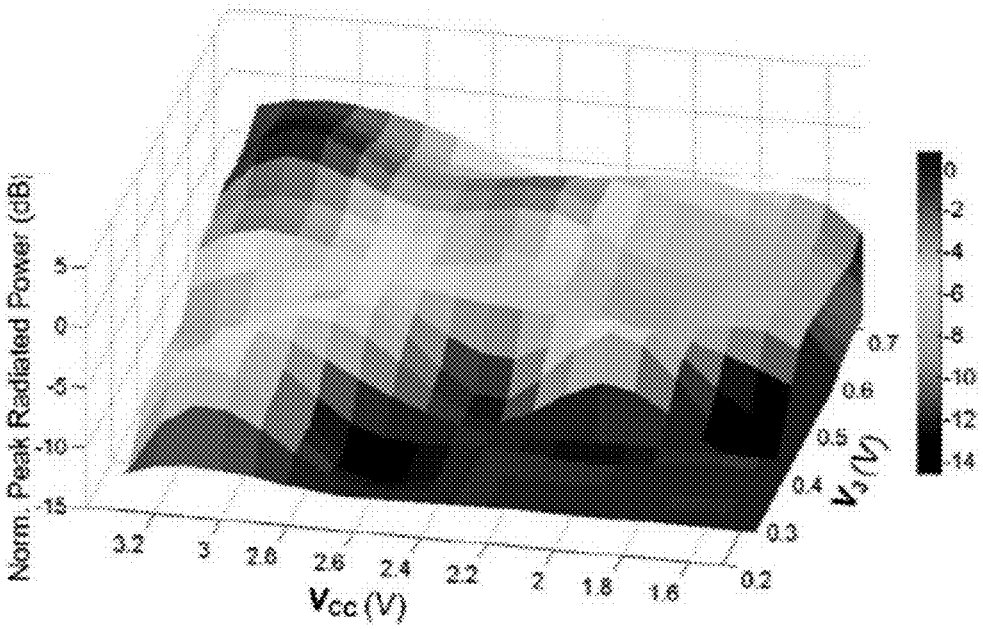
FIG. 18 shows a 3D surface graph plot of normalized peak power of the radiated pulse versus input biasing and supply voltage of the current-switch.

The current-switch stage in this design is based on a cascode architecture. Changes in the bias voltages of the current-switch stage affect the amplitude of the radiated pulse. The effects of input biasing of this stage, $V_3$, and the supply voltage, $V_{CC}$, are explored in FIG. 18, which shows a 3D surface graph plots the normalized peak power of the radiated pulse versus input biasing and supply voltage of the current-switch. These two voltages significantly affect the power consumption, as well as the parasitic capacitors, hence the amplitude of the radiated pulse. The maximum peak power of the radiated pulse does not necessarily occur at the highest supply voltage. The effect on pulse shape is not observed and the pulse shape stays consistent due to the filtering of the antenna on the signal, after the current-switch.

The peak pulse EIRP and peak radiated power of the THz impulse radiator is calculated based on the time-domain measurements. In EIRP measurements, no Teflon lens is used and the receiver is placed at a 2 cm distance. As shown in FIG. 15, the peak voltage of the received pulse is 12 mV. In order to use the Friis equation to calculate EIRP, we need to calibrate the gain of the receiver. This calibration is performed using frequency-domain measured data at 140 GHz (center frequency of the pulse spectrum) and the calibrated gain of the receiver at 140 GHz is $G_r$=1 dB. Also, the received power based on TD measurement is $P_r$=−25 dBm. Thus, the peak EIRP of the radiator, calculated based on the receiver gain of 1 dB at 140 GHz, distance of R=2 cm, and center frequency of 140 GHz, is $$EIRP_{peak} = \frac{P_r}{G_r}\left(\frac{4\pi R}{\lambda}\right)^2 = 15 \text{ dBm} \tag{5}$$

in which Δ=2.1 mm is the wavelength of the pulse center frequency in air. Based on the measured peak pulse EIRP and the transmitter gain at 140 GHz ($G_t$=11 dB), the peak radiated power is also calculated as $$P_t = \frac{EIRP_{peak}}{G_t} = 2.5 \text{ mW}.$$

0.05-1.1 THz Frequency-Domain Measurements:

The frequency-domain (FD) measurement setup is shown FIG. 19. The mixer port of a Keysight N9030A PXA Signal Analyzer is used with OML Harmonic Mixers and Horn Antennas WR-15, 10, 08, 05, 03 for 0.05-0.325 THz measurements, and VDI SAX and Horn Antennas WR-2.2, 1.5, 1.0 for 0.33-1.1 THz frequency domain measurements. The distance between the chip and the horn antennas is greater than or equal to 4 cm in all of the measurements. A 5.2 GHz trigger signal with 10 dBm power is biased with a Bias-T and then fed to the 50Ω input of the chip. The generated frequency tones of the impulse radiation are measured at the harmonics of 5.2 GHz, up to 1.1 THz.

Figure 21:
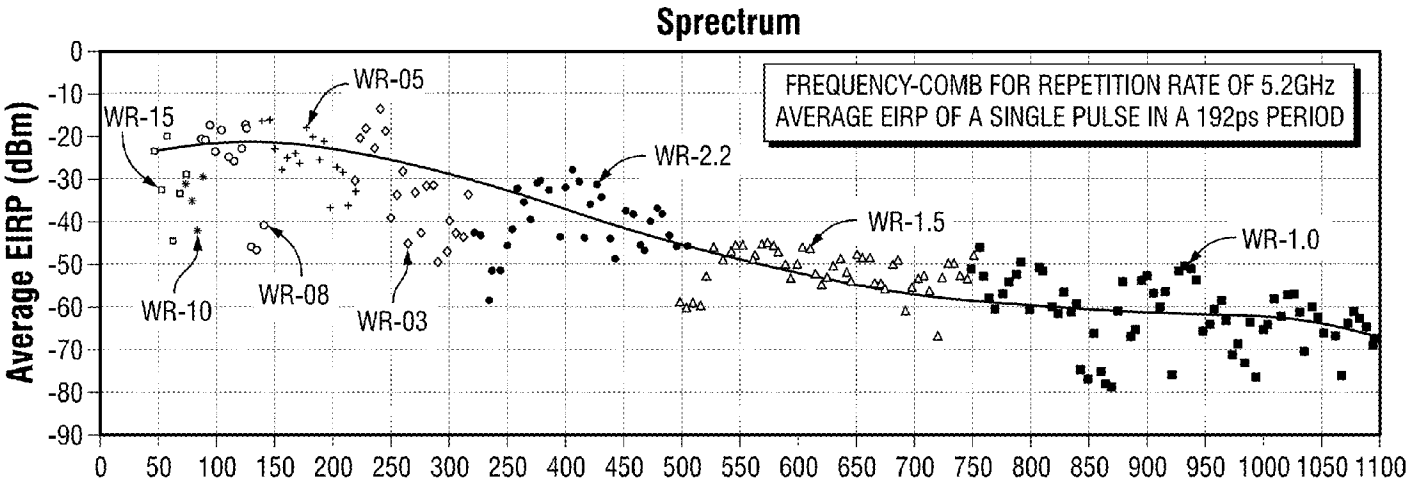
FIG. 21 shows average Effective Isotropic Radiated Power (EIRP) of a radiator based on the frequency.
Figure 22:
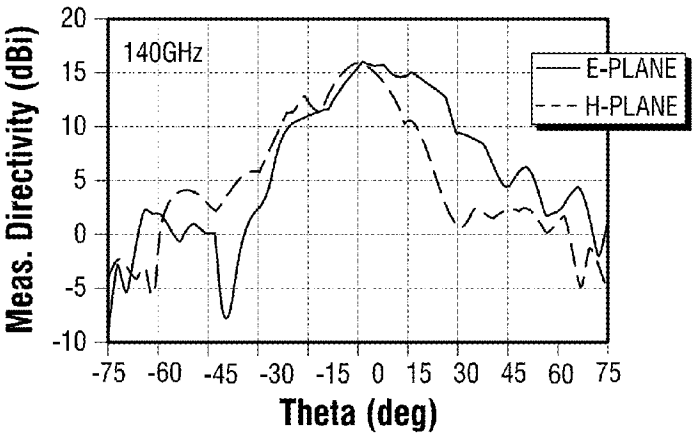
FIGS. 22-23 respectively plot the E- and H-plane radiation at 140 GHz and 1.1 THz.
Figure 23:
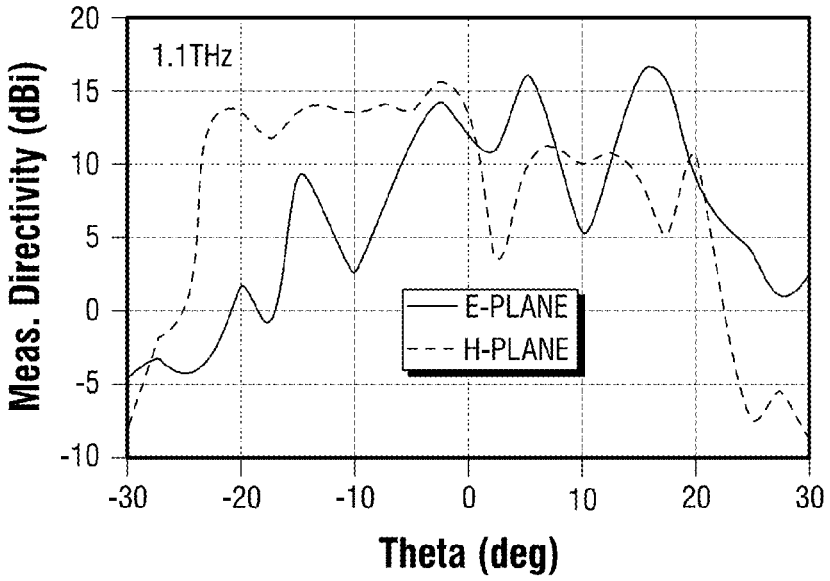

FIGS. 20A-20F shows the sample frequency components measured at 1.10 THz with 20 dB SNR, 1.08 THz with 22 dB SNR, 0.90 THz with 30 dB SNR, 0.81 THz with 33 dB SNR, 0.75 THz with 40 dB SNR, and 0.60 THz with 40 dB SNR. The SNR numbers reported are measured at the receiver, which is at a more than 4 cm distance from the chip, hence the SNR at the transmitter is higher. The average Effective Isotropic Radiated Power (EIRP) of the radiator is calculated based on the frequency component measurements for 0.05-1.1 THz frequency range and plotted in FIG. 21. The EIRP numbers are calculated based on the Friis transmission equation. It should be noted that the numbers reported in FIG. 21 are average EIRP values for the pulse radiator with 1.9 ps pulses with a period of 192 ps (5.2 GHz repetition rate). The FD radiation pattern of the THz impulse radiator chip is also measured at two frequency components: the center frequency of the radiated pulses, 140 GHz, and the maximum frequency component measured, 1.1 THz. FIGS. 22-23 plot the E- and H-plane radiation at these frequencies. The measured directivities at 140 GHz and 1.1 THz, is 16 dBi and 18 dBi, respectively.

Figure 24A:
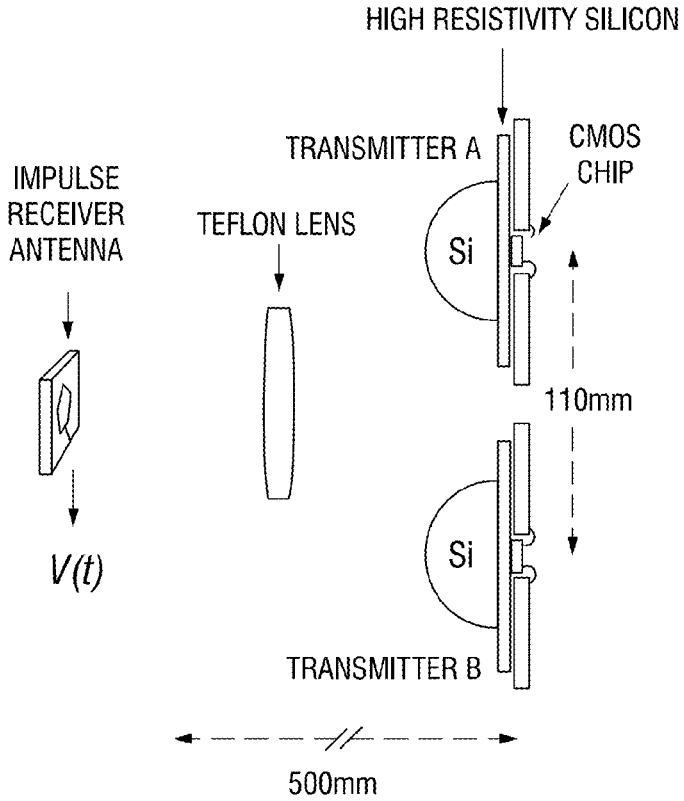
FIG. 24A shows a measurement setup of multi-element array.
Figure 24B:
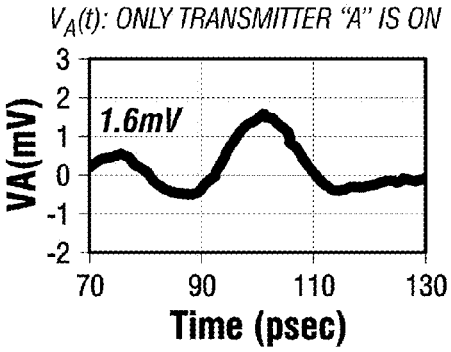
FIGS. 24B-24D respectively show transmitted signals from transmitters A and B, and a measured coherently combined signal and algebraic sum of the received signals.
Figure 24D:
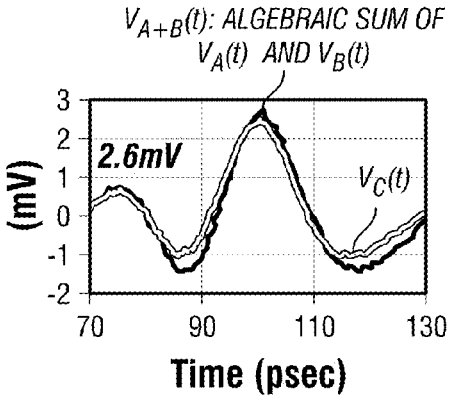
Figure 24C:
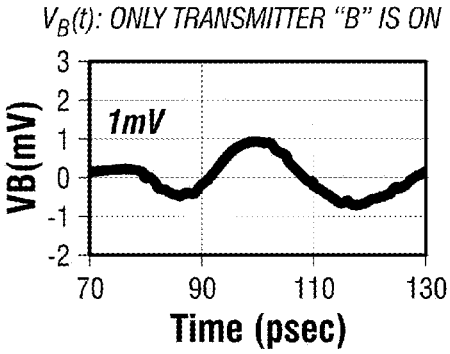
Figure 25:
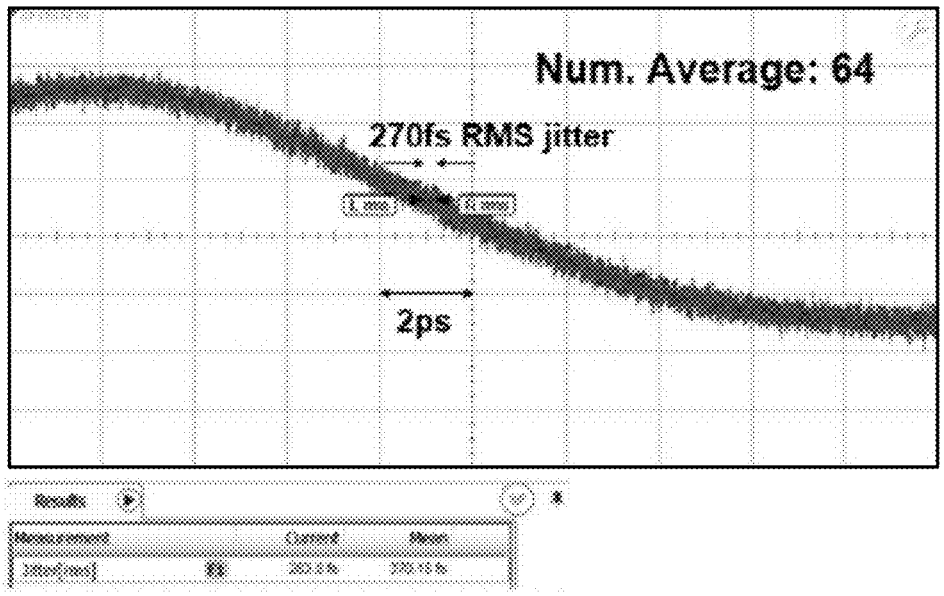
FIG. 25 shows jitter of a combined signal.

Coherent Spatial Combining of Impulses from Widely Spaced Radiators:

Precision synchronization between the digital trigger and the radiated impulse enables coherent combining of radiated impulses from widely spaced antennas with increased effective aperture size. In some embodiments, the array elements can be synchronized with each-other with timing accuracy of equal to or better than 100 fsec. To demonstrate this, the radiated THz pulses from two separate widely spaced chips is combined in space. The measurement setup of this experiment is shown in FIG. 24A. A custom PCB-based inverted cone planar antenna is designed and used as the receiving antenna in this experiment. The receiving antenna is directly connected to a Keysight remote sampling head 86118A. FIG. 24D shows that the measured coherently combined signal matches with the algebraic sum of the received signals separately measured from individual radiators (FIGS. 24B-24C), when the other is off. The timing jitter of the combined signal is calculated by a Keysight 86100DCA sampling oscilloscope and an RMS jitter of 270 fs is measured for an averaging of 64 (FIG. 25). The measured jitter for 256 and 512 averaging is 220 fs and 130 fs, respectively.

Conclusion:

A fully-integrated impulse radiator chip based on a novel oscillator-less direct digital-to-impulse architecture is introduced that is capable of radiating THz pulses with FWHM of 1.9 ps, with 3 dB-BW of 155 GHz (6 dB-BW of 215 GHz) centered at 140 GHz. The starting time of the radiated impulses is locked to the edge of the input digital trigger with a high precision that results in ultra-high spectral purity of the generated harmonic tones. Broadband 0.05-1.1 THz signal generation and radiation is demonstrated with a received SNR of 22 dB at 1.1 THz, 28 dB at 1.0 THz, and 30 dB at 0.9 THz, in a 130 nm SiGe BiCMOS process with an $f_T$ of 200 GHz and an $f_{max}$ of 280 GHz. A 10 dB-below-peak spectral width of only 2 Hz at 1.1 THz is measured that shows the extremely high locking accuracy between the THz pulse radiated and the input trigger. A novel time-domain THz pulse measurement is developed using a femtosecond-laser-based THz-TDS system with the fully-electronic chip as its THz pulse radiator. The effect of bias and supply voltages of the current switch stage on the radiated impulses is experimented. A chip micrograph is shown FIG. 26.

4×2 Arrays: A nonlimiting example of a fully-integrated broadband 0.03-1.032 THz radiating array is discussed herein. Coherent spatial combining from 8 elements is successfully demonstrated. The combined signal achieves a jitter of 270 fsec, a record pulse-width of 5.4 psec, and/or an impulse peak EIRP of 30 dBm. Each array element includes a programmable delay with step resolution of 300 fsec and dynamic range of 95 psec. Frequency-domain measurements are performed up to 1.032 THz. Frequency stability of the radiated impulses is better than 2 Hz at 0.750 THz. Time-domain radiated signals are measured by a THz optical sampling system. This is the first time that a fully-electronic chip is characterized and used as a THz emitter in an optical THz-TDS system. The array chip is fabricated in a 90 nm SiGe BiCMOS process.

As noted previously, PCT/US2014/058019 discusses prior work on an impulse radiator, but does not discuss the programmable on-chip delay generator discussed herein. An array of direct digital-to-impulse radiating elements (e.g. 4×2 array) is discussed herein, where each array element is equipped with a programmable delay line that can control the timing of the impulse release (e.g. with steps of 300 fsec and dynamic range of 95 psec). Furthermore, the chip may radiate broadband impulses with SNR>1 bandwidth of more than 1 THz. The measured received SNR at 1.032 THz is 1 dB, at 0.963 THz is 3.2 dB, and at 0.927 THz is 10 dB. These values are based on the signal received at a distance of several centimeters and after the conversion loss of mixer and the actual radiated and received SNR is higher than these numbers. The experiments show that the silicon technology discussed can produce signals in frequencies exceeding 1 THz. Furthermore, due to the near ideal spatial combining of multiple radiating elements, a high peak impulse EIRP (e.g. 30 dBm (1 W)). Further, a fully-electronic chip was used and characterized as a THz emitter in an optical THz time-domain spectroscopy (THz-TDS) system.

Circuit Architecture

Figure 27:
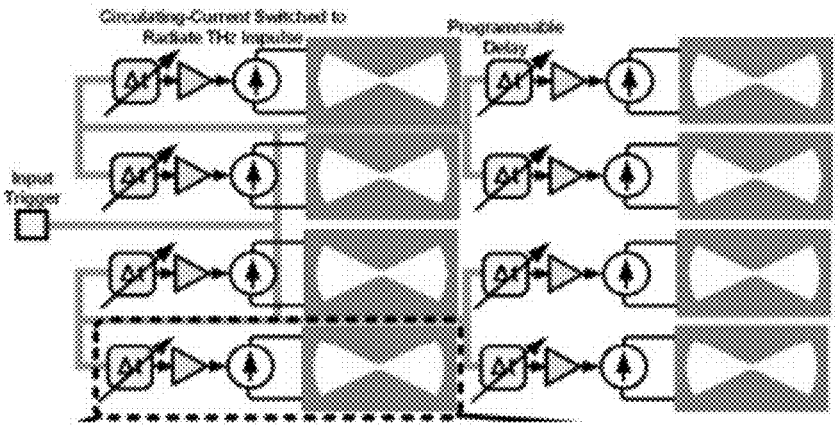
FIG. 27 shows a 4×2 array.

The architecture of an impulse-radiating array is shown in FIG. 27, particularly 4×2 array. Each impulse-radiating element corresponds to design shown in FIG. 1E. In this design, an external digital trigger signal with a short rise time is fed to the input of the chip. The trigger signal is distributed by an H-Tree distribution network and routed to the input of a programmable delay at the location of each element. The programmable delay is based on a digital delay architecture, which adjusts the delay by changing the supply voltage ($V_{DD}$) of the digital buffers or the output of the DAC in FIG. 3C. As a nonlimiting example, this element may be capable of producing delays with step resolution of 300 fsec and dynamic range of 95 psec. In addition to introducing delay, a series network of digital buffers converts the input signal to a square wave with a short rise/fall time, e.g. shorter than 30 psec. After this step, the trigger signal passes through a bipolar edge-sharpening amplifier that employs inductive peaking to reduce the rise/fall time, e.g. to less than 6 psec. As shown in FIG. 1E, for every rising edge of the external trigger, the current of the slot bow-tie antenna is disconnected, resulting in a coherent radiation of an impulse with a low Full Width at Half Maximum (FWHM), e.g. 5.4 psec. To minimize the ringing effect and ensure a fast delivery of charges to the output node, a series of transmission-line capacitor network is carefully designed. This network provides a near-ideal supply voltage for the impulse radiator.

A detailed design corresponding to each impulse-radiating element is shown in FIG. 11 and discussed previously above. The bipolar edge-sharpening amplifier utilizes the technique of inductive peaking to reduce the fall time, and this fast transition in voltage is buffered with another bipolar transistor before being fed to the base of a cascode element shown. The cascode design noted previously is chosen to mitigate the miller effect and enhance the bandwidth of the impulse. The cascode element turns off $i_c(t)$ and $i_{ant}(t)$ (FIG. 11) and causes the impulse radiation.

Measurement Results

Figure 14:
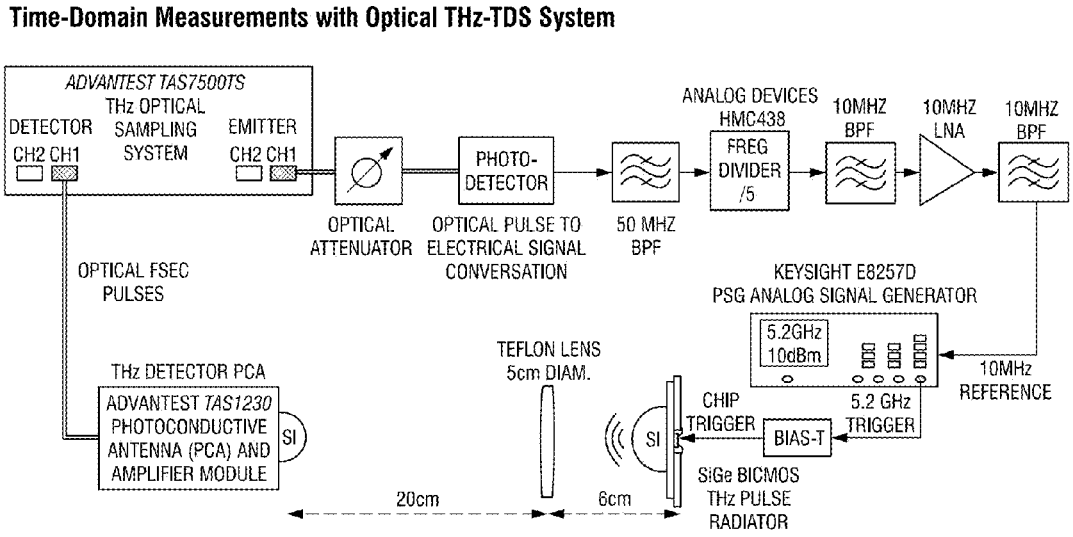
FIG. 14 shows a time-domain measurement setup.

The measurement setup for characterizing the time-domain response and frequency-spectrum of the radiated impulse train were shown in FIGS. 14 & 19. To characterize the time-domain waveform of the radiated impulse, an Advantest TAS7500TS THz optical sampling system with an Advantest TAS1230 photoconductive antenna (PCA) are used. Optical pulses are converted to electrical signals and are fed to trigger input of the SiGe THz impulse radiating array. Thus, impulse radiation is locked to the fsec laser and is coherently measured by the THz-TDS system. To measure the frequency spectrum up to 1.1 THz, a Keysight N9030A PXA signal analyzer with OML harmonic mixers 15, 10, 08, 05, 03 as well as VDI SAX WR-2.2, 1.5, 1.0 is utilized. In each frequency band, a horn antenna couples the received signal to the mixer.

Figure 28A:
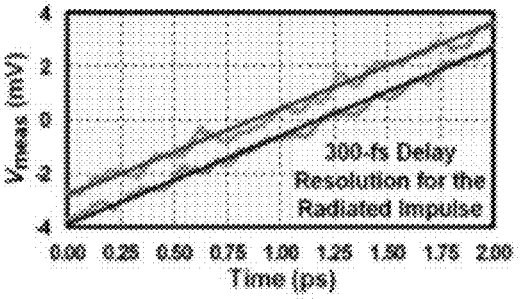
FIGS. 28A-28B respectively show a delay generator can delay the radiated impulse, and amplitude of an impulse can be modulated with $V_2$.
Figure 28B:
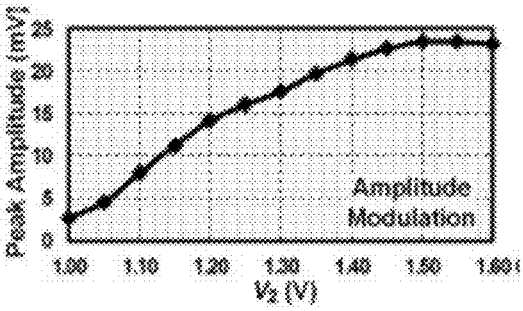

The measured FWHM of the impulse is 5.4 psec. FIGS. 28A-28B also shows the delay generator can successfully delay the radiated impulse by step resolution of 300 fsec and the amplitude of the impulse can be modulated. In order to measure the peak EIRP and jitter of the radiated impulse train, a wideband custom PCB-based impulse receiver antenna with an Agilent DCA86100 with sampling head 86118A is used. Based on a 3-GHz repetition rate, a peak EIRP of 30 dBm is measured. The measured timing jitter of the radiated impulse is about 270 fsec with 64 times averaging. Averaging is used to reduce the noise of the sampling head of the oscilloscope.

Figures 29A, 29B, 29C, 29D, 29E:
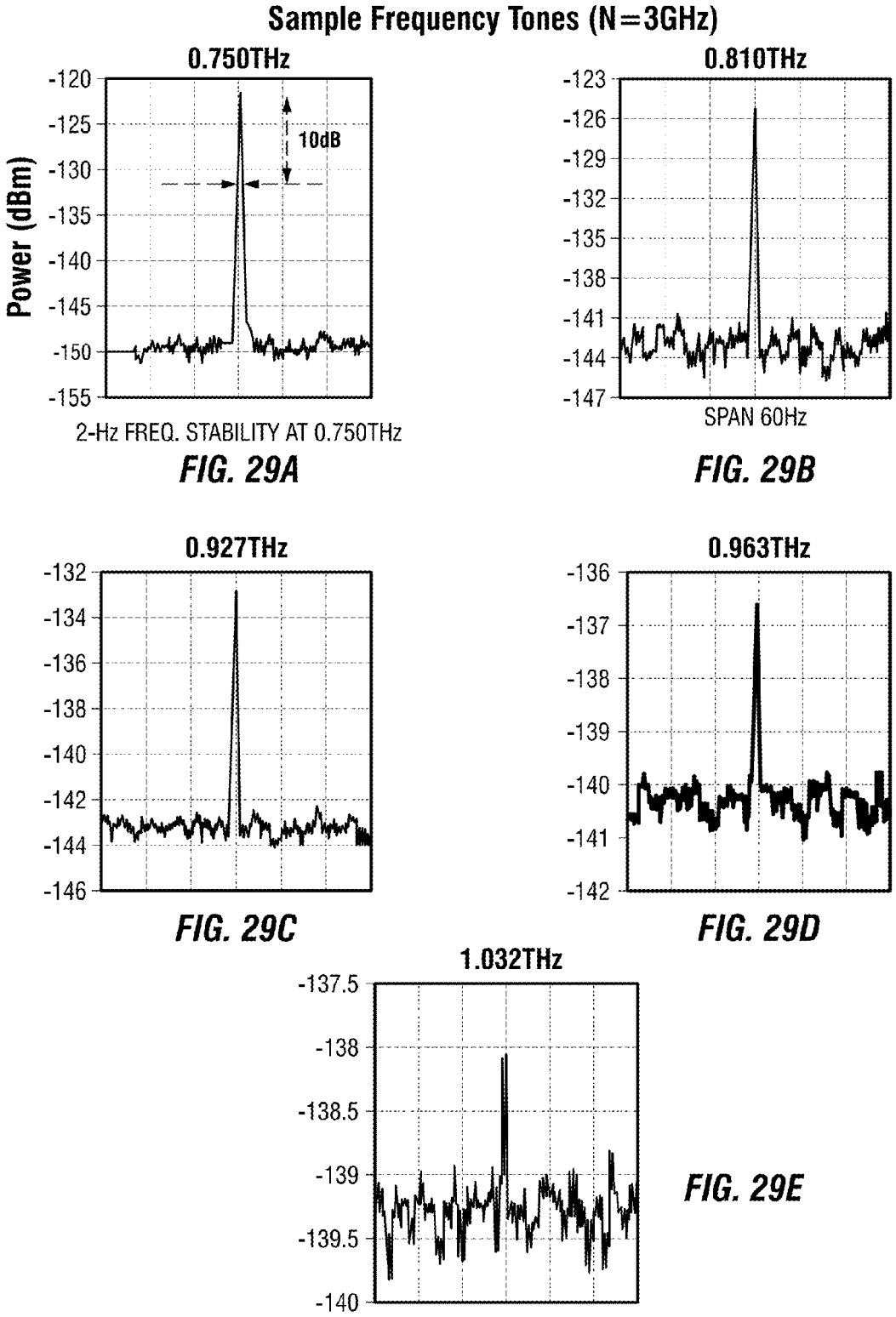
FIGS. 29A-29E respectively show various sample frequency tones (N×3 GHz)
Figure 29F:
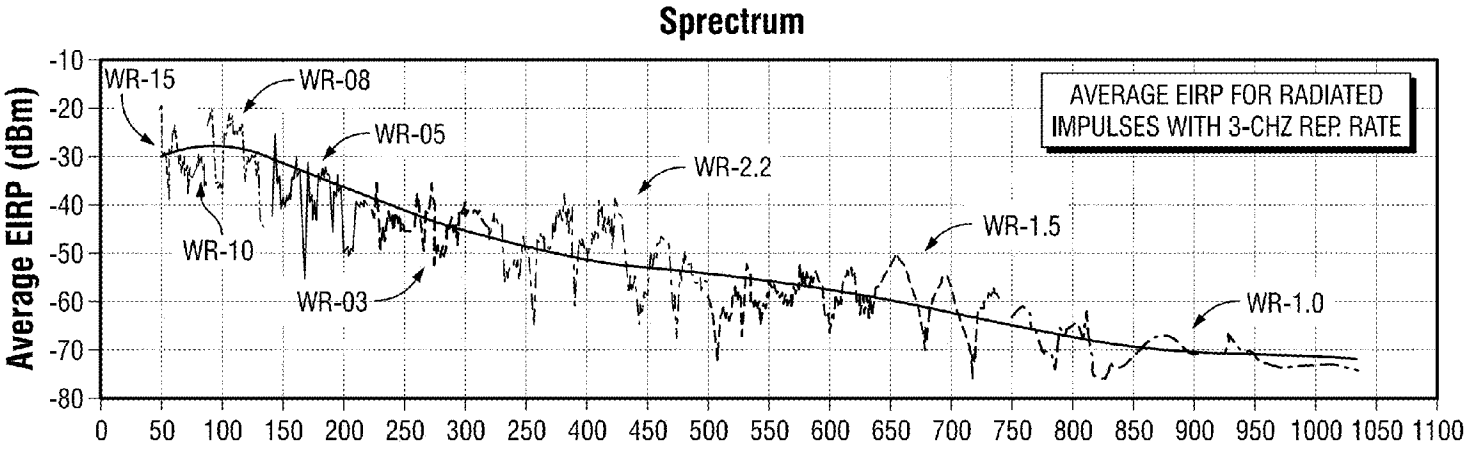
FIG. 29F shows average EIRP from 51 GHz to 1.1 THz.
Figure 29H:
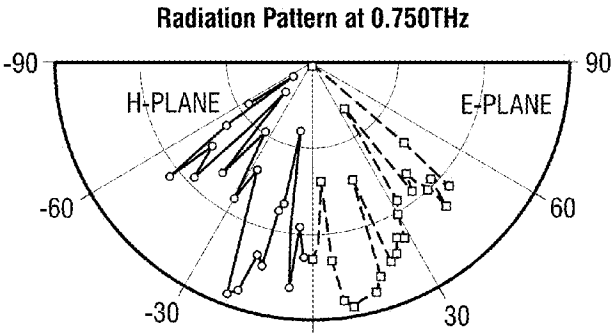
FIGS. 29G-29H respectively show a chip arrangement and measured radiation pattern at 0.75 THz.
Figure 29G:
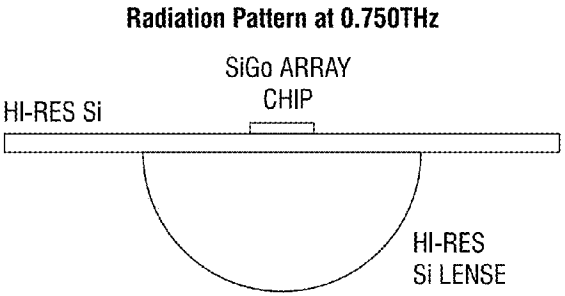

The received frequency spectrum measured up to 1.1 THz is shown in FIGS. 29A-29E. Since the trigger signal has a repetition rate of 3 GHz, the radiated impulses form an impulse train with a repetition rate of 3 GHz. Based on the measured spectrum, an SNR of 1 dB at 1.032 THz, 3.2 dB at 0.963 THz, 10 dB at 0.927 THz, 15 dB at 0.810 THz, and 28 dB at 0.75 THz is achieved. It is also shown that the frequency tones generated by the impulse train have the stability of better than 2 Hz at 0.75 THz (2.7 parts in trillion). This level of frequency stability enables ultra-sensitive spectroscopy in the THz regime. FIG. 29F shows the average EIRP from 51 GHz to 1.1 THz, where the energy of the impulse train is divided to 328 tones separated by 3 GHz (repetition rate) and unlike continuous-wave, radia. The EIRP at each frequency tone is calculated based on the Friis formula. The chip arrangement and measured radiation pattern at 0.75 THz is also shown in FIGS. 529G-29H.

Conclusion

This work demonstrates the generation and radiation of highly-stable frequency tones up to 1.032 THz for the first time. A frequency stability of less than 2 Hz at 0.75 THz is achieved (2.7 parts in trillion). In addition, ultra-short impulses with duration of 5.4 psec, repetition rate of 3 GHz, and peak EIRP of 30 dBm (1 W) is reported. The chip is capable of adjusting both the amplitude and timing of the radiated impulses. The integrated delay lines in each element achieves timing resolution of 300 fsec and dynamic range of 95 psec. The total DC power consumption the chip is 710 mW. For the first time, a fully-electronic impulse radiator is characterized by a THz optical sampling system.

The entire 4×2 array occupies an area of 1.6 mm by 1.5 mm including the pads. The chip is fabricated in IBM 90 nm SiGe BiCMOS process technology.

Discussion of the antenna aspects of the design as well as the architecture of the broadband THz array were discussed previously above. Each impulse-radiating element of a 4×2 array corresponds to design shown in FIG. 1E and a detailed design corresponding to each impulse-radiating element is shown in FIG. 11.

Antenna Design: Array Architecture and Measurement Results

Conventional phased arrays utilize different methods for adjusting the time delay required for beamforming. The most common method is introducing delay elements in the signal path (RF path). These delay blocks distort the signal due their nonlinear behavior, and these architectures depend on the time-domain waveform of the RF signal, which is an undesirable effect. LO-path phase shifting is another method, where the phase shift is implemented in the LO path. Unfortunately, the method of LO-path phase shifting is narrowband and cannot be used in broadband arrays.

The architecture discussed allows for broadband beamforming that excludes time delay from the signal (information) path. As shown in FIGS. 3A & 3C, delay generators are implemented on the trigger path that controls the timing of the impulse radiation. In this array architecture, the information is stored on the amplitude of the ultra-short impulse and beam-steering is performed by adjusting the timing of the trigger that fires the impulse. In this array the amplitude of the data signal can be controlled by adjusting V2, V3, or Vcc in FIG. 11. FIG. 28A shows time-domain measurement of two radiated impulses delayed by 300 fsec.

Figure 30A:
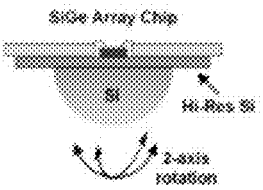
FIGS. 30A-30D respectively show an array chip and E- and H-plane radiation pattern at 0.33 THz, 0.57 THz and 0.75 THz.
Figure 30B:
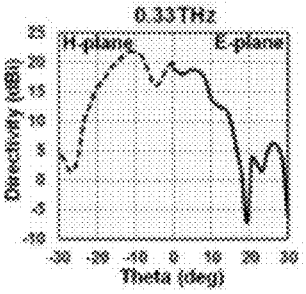
Figure 30C:
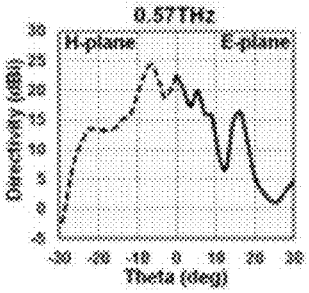
Figure 30D:
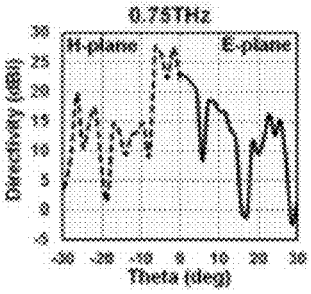

The entire 4×2 array occupies an area of 1.6 mm by 1.5 mm including pads, while a single element occupies only 650 μm by 300 μm. The antennas were fabricated on the top metal layer, which is made of aluminum and has a thickness of 4 μm. FIG. 30A shows the chip configuration, and the measured radiation patterns at 0.33 THz, 0.57 THz and 0.75 THz are shown in FIGS. 30B-30D. Maximum antenna array directivities of 22 dBi at 0.33 THz, 25 dBi at 0.57 THz, and 27 dBi at 0.75 THz are achieved in measurement.

Conclusion

An 8-element terahertz impulse-radiating array with integrated slot bow-tie antennas is implemented in a 90 nm SiGe BiCMOS process. Radiation is coupled to a silicon lens with a diameter of one inch and an extension of 500 μm, through the back of the chip. Spatial combining of broadband radiated impulses is demonstrated with a novel trigger-based beamforming architecture. A 300-fsec delay resolution is successfully measured for the radiated impulse.

4×4 Arrays: A 4×4 digital-to-impulse radiating array was also tested in CMOS. Like the prior 4×2 array, this 4×4 array utilized a similar architecture. In particular, each impulse-radiating element of the 4×4 array corresponds to design shown in FIG. 1E and a detailed design corresponding to each impulse-radiating element is shown in FIG. 11. Each antenna radiates impulses with minimum duration of 14 psec and a high repetition rate (e.g. 10 GHz). The radiated impulses are locked to an external digital trigger with timing jitter of equal to or better than 230 fsec. This low level of timing jitter and the ability to program the delay at each element enable a near-ideal spatial combing and/or beam steering.

Each individual element of this array may be equipped with an integrated programmable delay that shifts the timing of the digital trigger by fine steps (e.g. as small as 200 fsec (min)) and a dynamic range (e.g. 20 psec (max)). A 128-bit serial digital input may set the timing of the impulses radiated by all elements. The radiated impulses from the entire array were successfully measured and reported. It was demonstrated that the radiated impulses from 16 elements can be coherently combined in space. Furthermore, it is shown that the timing control provided by the delay generator at each element is desirable to precisely align the radiated impulses at a desired direction in space. When the number of the elements in an array increases, the pulse-width may increase which is an undesired effect. This is due to the non-ideal combing and timing jitter between array elements. In some embodiments, the peak EIRP of the 16-element transmitting array is equal to or greater than 17 dBm where the pulse duration is equal to or shorter than 14 psec. In some embodiments for an array size of 4 elements or larger, the array enables nonlimiting pulse-width of equal to or smaller than 1 nsec and equal to or greater than 14 psec.

In order to perform beam-steering in all angles, the delay between two adjacent array elements may have a desired maximum delay. As a nonlimiting example, this maximum required delay is 0.65 mm/3e8=2.16 psec in air and 0.65 mm/3e8×$12^{0.5}$=7.5 psec in silicon. In some embodiments, the maximum delay may be 7.5 psec or less. In some embodiments, the maximum delay may be 10 psec or less. In some embodiments, the maximum delay may be 15 psec or less. In some embodiments, the maximum delay may be 20 psec or less. This should provide enough delay to perform beam-steering in all angles. In some embodiments, the system may be capable of providing fine steps in the timing shift of the digital. As a nonlimiting example, timing of the digital trigger may be shifted by 500 fsec or less. In some embodiments, timing of the digital trigger may be shifted by 400 fsec or less. In some embodiments, timing of the digital trigger may be shifted by 300 fsec or less. In some embodiments, timing of the digital trigger may be shifted by 200 fsec or less.

Figure 31:
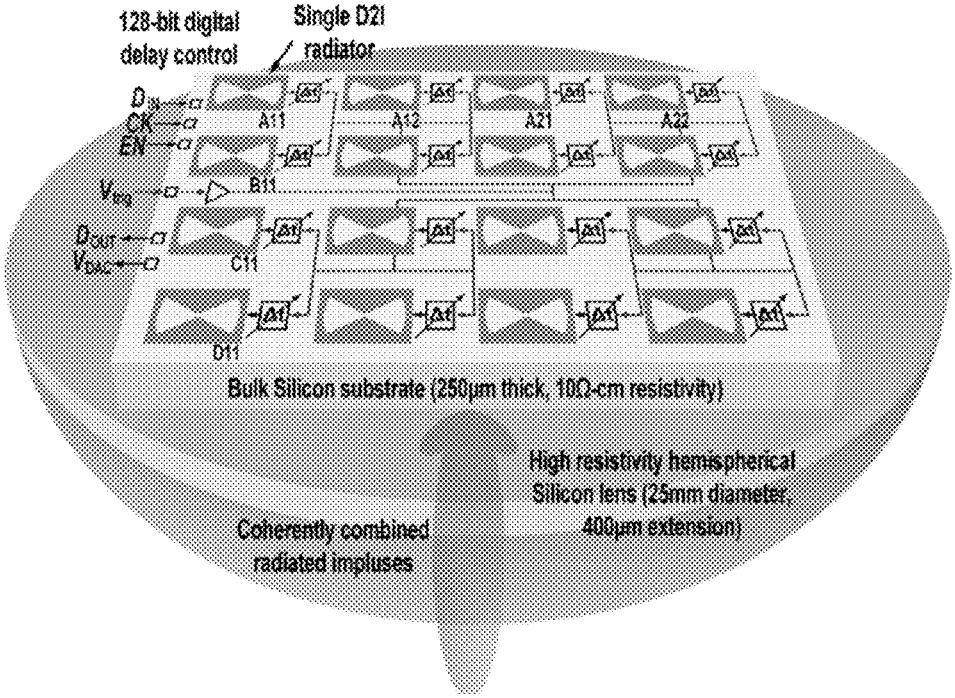
FIG. 31 is schematic of an architecture of a 4×4 digital-to-impulse radiating array.

FIG. 31 is a schematic of a block diagram of a 4×4 array. Each impulse-radiating element of a 4×4 array may correspond to design shown in FIG. 1E. A digital trigger is fed to the input and distributed to all 16 elements using an equidistance H-tree distribution. As discussed previously each element has a series of digital buffers that reduce the rise/fall time of the trigger signal to less than 30 psec and sends it to a programmable delay element. After adjusting the delay, the trigger signal is sent to an edge-sharpening amplifier to further reduce the rise/fall time and increase its amplitude. Then it is fed to a cascode switch. The switch is connected to an on-chip antenna through an impulse matching circuitry. When the switch is turned on, the impulse antenna and the pulse matching circuitry are energized by storing a DC current. When the switch is turned off, the energy stored in the antenna is released and converted to impulse radiation. A broadband slot bow-tie antenna is designed to radiate ultra-short impulses.

A detailed design corresponding to each impulse-radiating element is shown in FIG. 11. The impulse-radiating element may operate in the manner discussed previously. In the proposed topology, each individual radiator can operate in two modes. In the first mode a positive impulse is radiated, which is locked to the rising edge of the digital trigger, and in the second mode, a negative impulse is radiated and locked to the falling edge of the digital trigger. As shown in FIG. 11, the voltage at node $V_3$ activates one or both of these modes. The control voltage $V_2$ modulates the peak amplitude of the radiated impulse. A distributed network of bypass capacitors may be used at the biasing nodes to ensure fast delivery of charges at the time of switching. In some embodiments, the slot bow-tie antennas are fabricated using a copper metal layer. The edges of the antennas may be curved to achieve larger bandwidth and smaller peak resistance. The antenna may be coupled to a silicon lens with a diameter of 25 mm and an extension length of 0.4 mm. The lens may have a resistivity of 10 KΩcm. The silicon lens increases the radiation efficiency by minimizing the substrate modes and reducing the ringing effects.

As discussed previously, the delay of the trigger signal at each element is controlled using an 8-bit serial data. FIG. 3C shows a detailed schematic of a programmable delay generator used at each element. The digital delay control is achieved by adjusting the supply voltage of a series of NOT stages through an on-chip DAC.

Figure 32A:
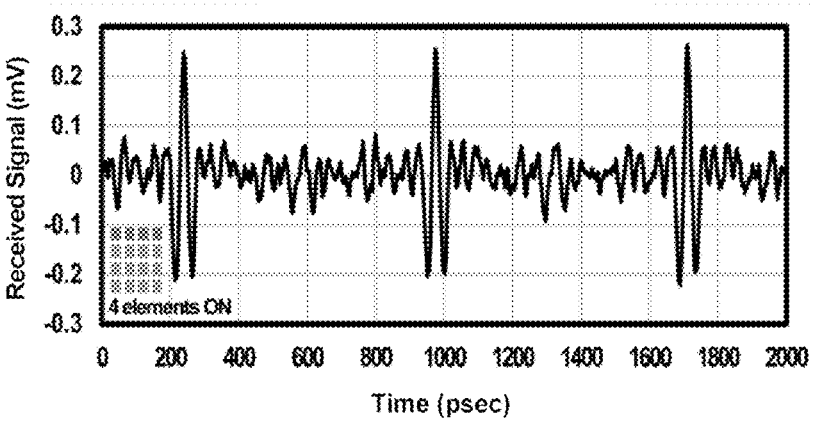
FIGS. 32A-32C show measured time-domain waveforms from 4 and 16 elements.
Figure 32B:
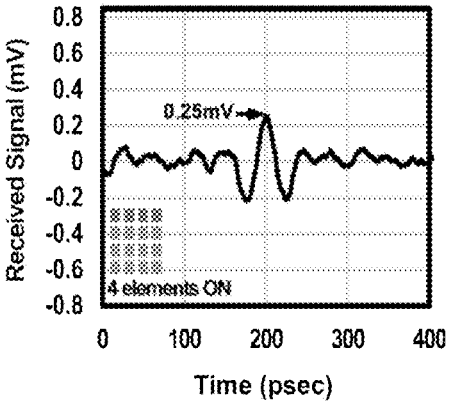
Figure 32C:
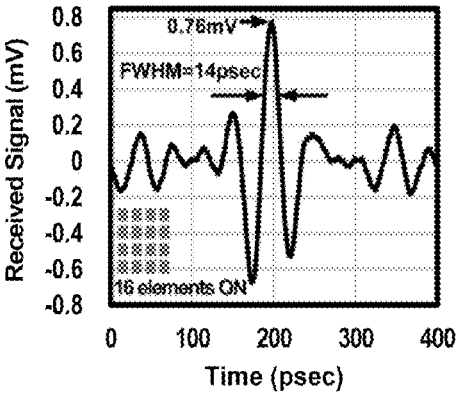
Figure 33:
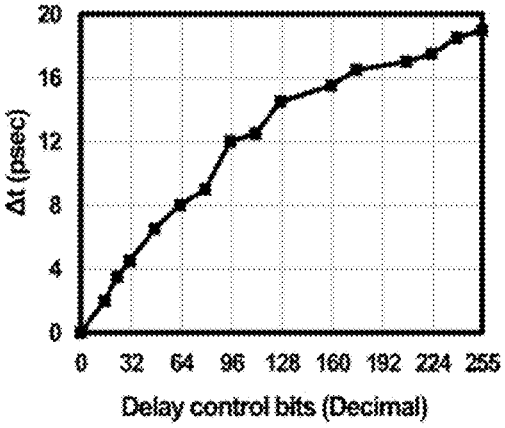
FIG. 33 shows measured delay at each element v. the digital input.

One of the major challenges in measurement of the ultra-short impulses is the receiver. The receiving antenna may preferably have a flat gain and a linear phase (constant group delay) in a wide range of frequencies. In this work, a custom PCB-based impulse receiving antenna was fabricated and used at the receiver. This antenna was directly connected to a wideband sampling oscilloscope Agilent DCA86100 with sampling head 86118A. In contrast to others, no mm-wave lens is used to focus the power onto the PCB antenna. Using a center frequency of 40 GHz and the Friis equation, a peak EIRP of 17 dBm for the combined signal from 16 elements is calculated. FIGS. 32A-32C shows the time-domain waveforms of the radiated signals from 4 and 16 elements. Due to the variation in the amplitude of radiation from different elements, in these plots, the combined amplitude of 16 elements is not equal to four times the amplitude of 4 elements. In this measurement, in order to coherently combine the signal from 16 elements, individual delays are tuned to maximize the amplitude. FIG. 33 illustrates the effect of the delay in coherent combining of the impulses.

The measured dynamic range of the delay generators at each element was 20 psec. FIG. 33 reports the measured delay versus the digital input in one of the elements, and FIG. 3B illustrates the effect of the delay in coherent combining of the impulses at the desired location in 3D space. Considering the size of the chip, the furthest distance between two elements is 2.4 mm (8 psec in air). Therefore, the dynamic range of 20 psec is sufficient to enable beam steering in all angles.

The jitter of the combined signal from all 16 elements was measured the measured RMS jitter with averaging of 64 and 128 was 230 fsec and 150 fsec, respectively. Averaging was used to reduce the noise of the sampling head in the oscilloscope.

Figure 26:
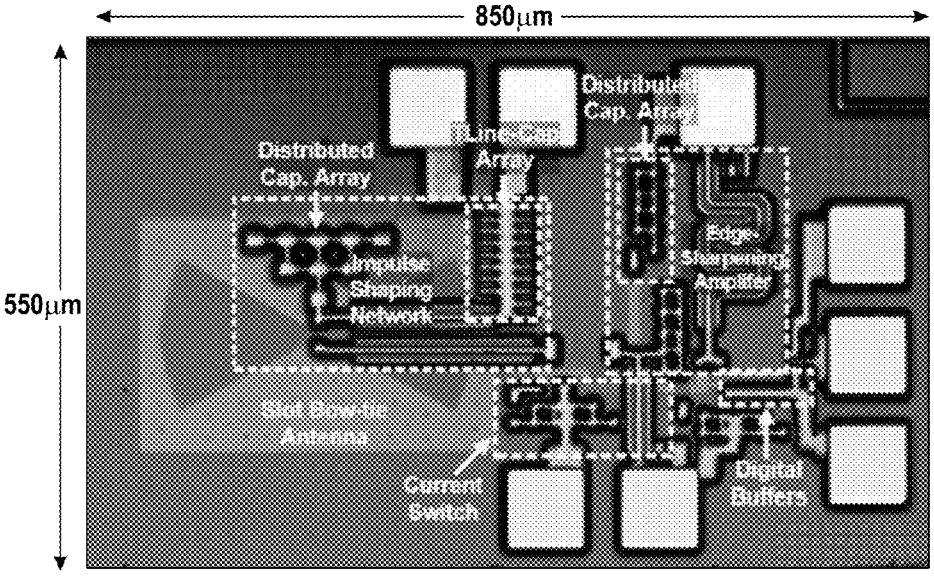
FIG. 26 shows a chip micrograph.
Figure 34A:
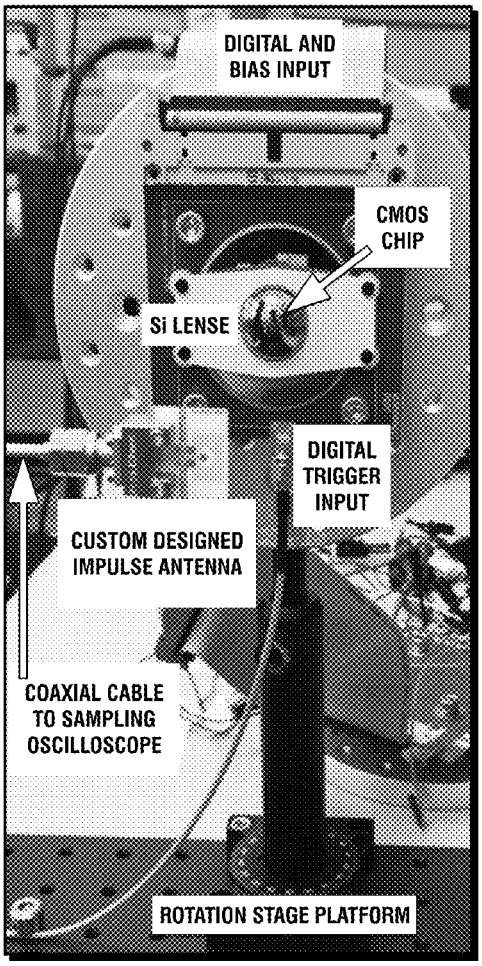
FIGS. 34A-34C show the measurement setup, the chip-on-board assembly and a radiation pattern of a digital-to-impulse array.
Figure 34B:
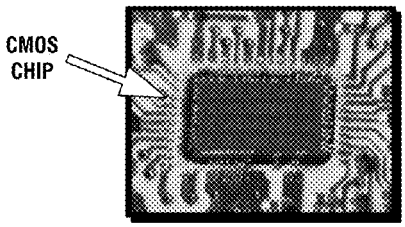
Figure 34C:
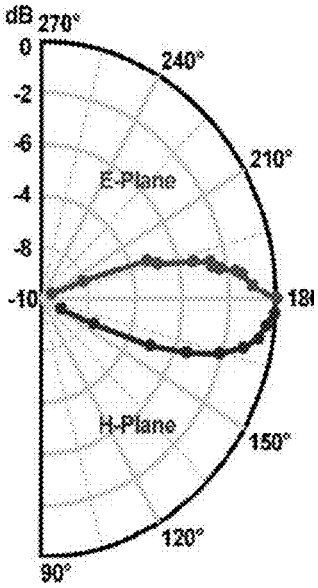

FIG. 34A-34B respectively show a testing setup and close up of the CMOS chip. FIG. 35C shows the H-plane and E-plane radiation patterns of the combined signal from 16 elements. The peak power of the radiated signal is used to measure the radiation pattern. The measured directivity of the array is 17 dBi. Table I summarizes the performance of the digital-to-impulse radiating array. FIG. 26 shows an image of a single element. Fill blocks are placed at the corners of the slot bow-tie antenna where the sensitivity to parasitic capacitance is maximum. The chip was fabricated in IBM 65 nm bulk CMOS process technology.

To the best of our knowledge, this is the first digital-to-impulse radiating array. All 16 elements of the array are equipped with a programmable delay generator. Coherent spatial combining from 16 elements is successfully demonstrated. The combined signal from 16 elements achieves a jitter of 230 fsec, a pulse-width of 14 psec, and an EIRP of 17 dBm. Each delay generator provides a delay resolution of 200 fsec and a dynamic range of 20 psec.

Gas Spectroscopy: The systems and methods discuss can also be used to perform broadband THz gas spectroscopy. A single-chip source provides us with a highly compact and cost-effective system comparing to a laser-based source. We have performed THz gas spectroscopy using two different gases, $NH_3$ and $H_2O$. The $NH_3$ measurements were performed at 572 GHz, its strongest absorption peak. At this frequency, $SO_2$ and $H_2S$ can be detected as well.

Custom Single-Chip Terahertz Source

Figure 35:
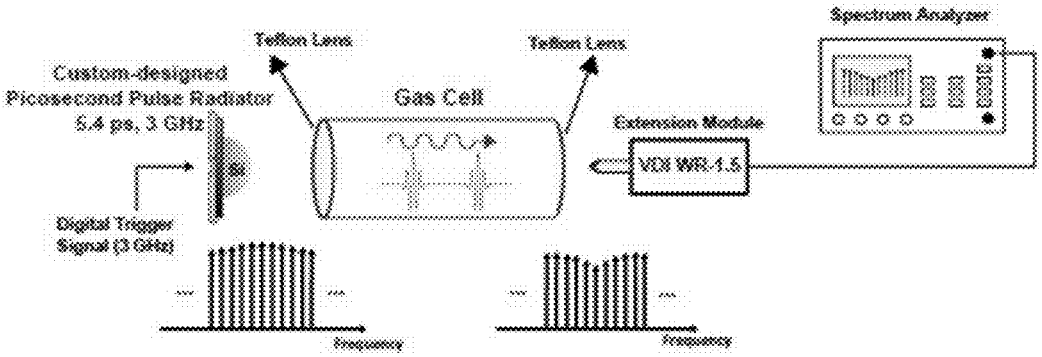
FIG. 35 show a gas spectroscopy experimental setup.

The architecture of the chip corresponded to the 4×2 array design shown in FIG. 1E, and a detailed design corresponding to each impulse-radiating element is shown in FIG. 11, and the chip operates in the manner discussed previously. The measurement results showing the radiated power from 50 GHz to 1.03 THz, are illustrated in FIG. 29F. The radiated impulse-train forms a frequency comb in the frequency domain, which spans from very low frequencies (30 GHz) up to 1.03 THz. The measured 0.75-THz component has a 2-Hz spectral width, which makes high-resolution spectroscopy possible. This source is used to perform terahertz spectroscopy on ammonia and humid air as discussed in Sections 3 and 4. The radiated frequency tones can be swept by changing the repetition rate of the input trigger source Experimental Setup The experimental setup is shown in FIG. 35. The absorption cell comprises a 50 mm diameter and 150 mm long aluminum tube with Teflon lenses at each end, which are transparent in the THz spectral range. The absorption cell is connected to an oil free vacuum pump via a pressure controller in order to regulate and reduce the gas flow in the cell. The terahertz-radiating chip is assembled on a printed circuit board, which has a silicon lens attached to its backside. The silicon lens helps to reduce the substrate modes caused by the planar geometry of the silicon chip. A Teflon lens, placed as the window of the absorption cell, collimates the propagating waves in the cell. The cell has a controlled pressure and is filled with 1% ammonia (99% nitrogen) calibrated gas in the first experiment. It is then filled with humid air in the second experiment. There is a second Teflon lens at the output end of the cell, which focuses the wave on the receiving antenna. The receiver is a commercial product of Virginia Diodes Inc., which includes a horn antenna and an extension module for the spectrum analyzer that works in the 500-750 GHz frequency band. A Keysight E8257D signal generator is used to provide an input trigger to the chip (source). The repetition frequency is fixed at 3 GHz for the first few measurements and then changed by steps of 10 MHz. By changing the repetition rate, the frequency tones in the frequency-comb are varied (harmonics of the repetition rate). A Keysight N9030A spectrum analyzer is connected to the VDI module to capture the spectrum on the receiver end.

Results

Figure 36A:
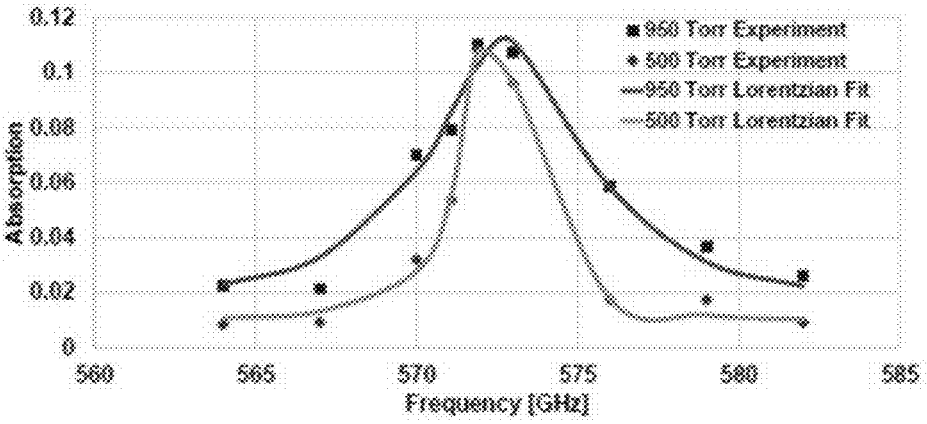
FIGS. 36A-36B respectively show measured absorbance of ammonia and water plotted as a function of frequency.
Figure 36B:
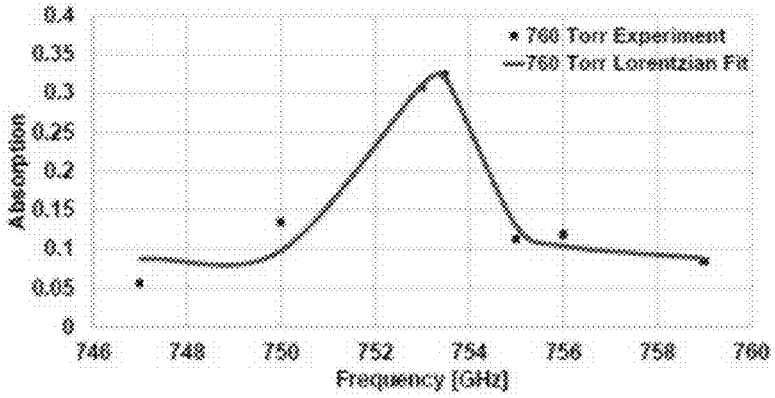

For each frequency component, the received power was measured twice. First, the cell is filled with pure nitrogen gas and then evacuated using a pump and filled with the trace gas. The absorption of the gas is calculated by comparing the received signals in two experiments. The measured absorbance of ammonia and water are respectively plotted as a function of frequency as shown in FIGS. 36A-36B. The ammonia concentration in the measured gas was kept at 1% while its pressure varied from 500 to 950 Torr to demonstrate the effect of pressure broadening. In the second measurement, the humidity of the air was approximately 50%, which causes 1.7 dB peak absorption at 753.5 GHz.

The 4×2 picosecond Direct Digital-to-Impulse (D2I) radiating array performs coherent spatial combining of broadband radiated pulses achieving an SNR>1 BW of 1.03 THz (at the receiver) with a pulse peak EIRP of 30 dBm. Time-domain radiation is characterized using a fsec-laser-based THz sampler and a pulse width of 5.4 ps is measured. Spectroscopic imaging of metal, plastic, and cellulose capsules (empty and filled) are demonstrated. This chip achieves signal generation with an available full-spectrum of 0.03-1.03 THz. The 8-element single-chip array is fabricated in a 90 nm SiGe BiCMOS process.

A single-chip 4×2 D2I array where ach impulse-radiating element corresponds to design shown in FIG. 1E was provided, and a detailed design corresponding to each impulse-radiating element is shown in FIG. 11. The 8-element array achieves a record peak pulse EIRP of 30 dBm (1 W) due to its near ideal spatial combining. The chip radiates broadband signals with SNR>1 bandwidth of higher than 1 THz. The measured SNR at the receiver is 1 dB at 1.032

THz, 10 dB at 0.927 THz, and 28 dB at 0.75 THz. The fullspectrum frequency-comb radiated from the array is used to demonstrate THz imaging using Off-Axis Parabolic Mirrors (OAPM) to focus the beam into a spot size smaller than 1 mm. The high SNR at the receiver enables fast scanning of the imaged sample with a few number of averaging.

Terahertz Spectroscopic Imaging

Figure 37A:
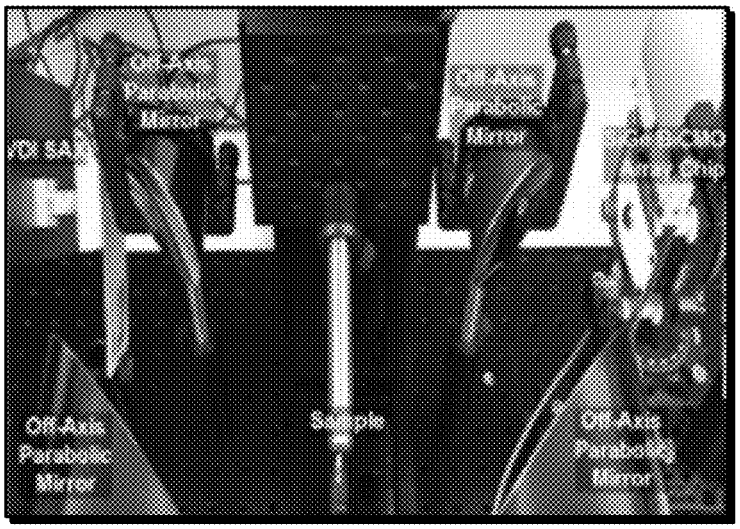
FIGS. 37A-37E respectively show a THz imaging setup and sample THz images acquired at 330 GHz and 609 GHz from different samples.
Figure 37B:
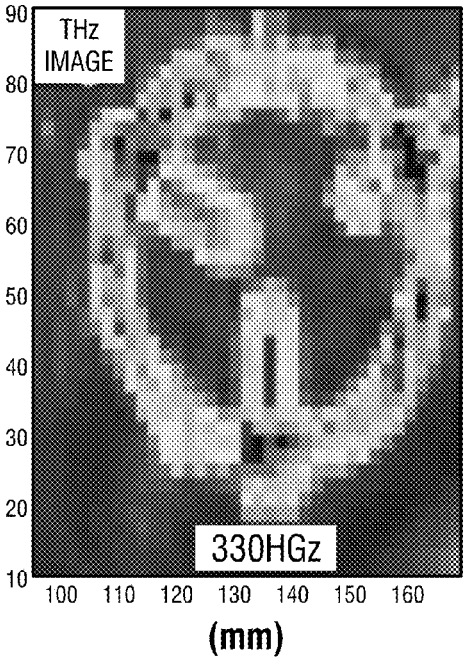
Figure 37C:
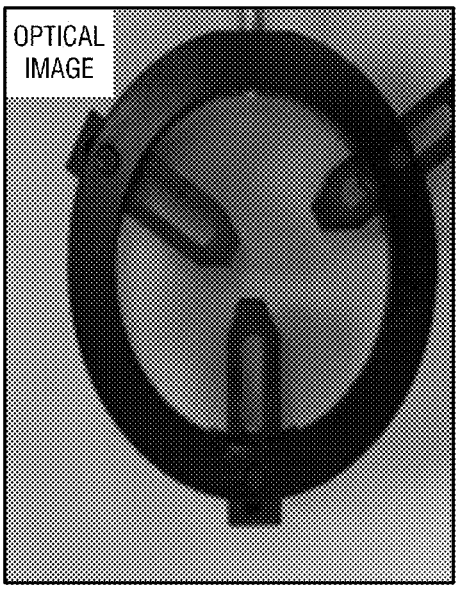
Figure 37D:
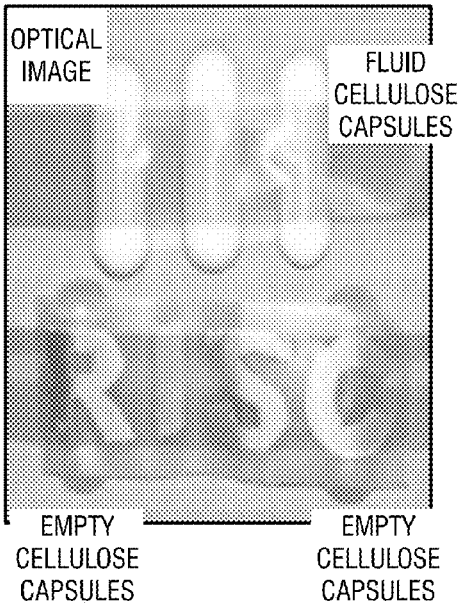
Figure 37E:
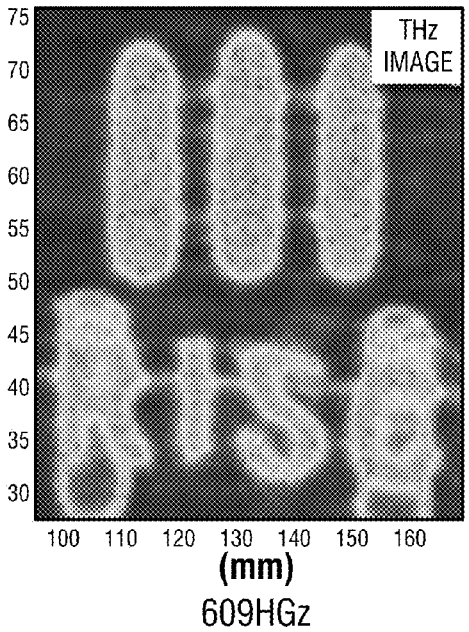

The broadband highly-dense spectrum of the impulse radiating array enables producing high resolution images with spectral information of more than 1 THz. As shown in FIG. 37A, a THz transmission imaging setup is built using four Off-Axis Parabolic Mirrors (OAPM). The center of radiation of the chip is aligned at the focal point of the first OAPM, hence the radiated beam is collimated and then focused by the second OAPM into a focal point with a spot size of less than 1 mm (for frequencies higher than 330 GHz). The imaged object is placed and scanned by the focal point. On the receiver side, a third OAPM collimates the transmitted beam and a fourth OAPM focuses the beam on the receiver horn antenna. The dense frequency-comb nature of an impulse train spectrum allows multi-color full-spectrum imaging of samples. FIGS. 37B-37E shows sample THz images acquired at 330 GHz and 609 GHz from different samples.

Table I compares the performance of the chip with prior work. The 4×2 array chip size is 1.6 mm×1.5 mm while a single element only occupies 300 um×650 um. The chip is fabricated in a 90 nm SiGe BiCMOS process technology.

| Performance | This work | [3] IMS 2014 | [4] RFIC 2014 |
|---|---|---|---|
| Highest Frequency Measured with SNR > 1 | 1.032 THz | 220 GHZ | N/A |
| Shortest Radiated Pulse Width | 5.4 ps | 8 ps | 9 ps |
| Peak EIRP (dBm) | 30 | 13 | 10 |
| Time-Domain Measurement | Yes (with locking)** | Yes (with locking) | Yes (with locking) |
| Frequency-Domain Measurements | Yes | Yes | No |
| Pulse Generation Method | Digital-to-Impulse | Digital-to-Impulse | Digital-to-Impulse |
| Power Consumption (mW) | 710 | 220 | 260 |
| Die Area ($mm^3$) | 2.4 | 0.47 | 0.88 |
| Technology | 90 nm SiGe BiCMOS | 130 nm SiGe BiCMOS | 130 nm SiGe BiCMOS |

Embodiments described herein are included to demonstrate particular aspects of the present disclosure. It should be appreciated by those of skill in the art that the embodiments described herein merely represent exemplary embodiments of the disclosure. Those of ordinary skill in the art should, in light of the present disclosure, appreciate that many changes can be made in the specific embodiments described and still obtain a like or similar result without departing from the spirit and scope of the present disclosure. From the foregoing description, one of ordinary skill in the art can easily ascertain the essential characteristics of this disclosure, and without departing from the spirit and scope thereof, can make various changes and modifications to adapt the disclosure to various usages and conditions. The embodiments described hereinabove are meant to be illustrative only and should not be taken as limiting of the scope of the disclosure.

What is claimed is:

1. A method for generating and radiating an impulse, the method comprising:

receiving a trigger signal and a data signal, wherein a trigger signal path is separated from a data signal path;

controlling the timing of a current applied to an antenna in accordance with the trigger signal; and controlling the amplitude of the current applied to an antenna in accordance with the data signal, wherein an impulse that is outputted is from an impulse radiator of an array of impulse radiators, wherein at least one impulse radiator of the array comprises an input for receiving the trigger signal, a delay generator for delaying the trigger signal, a current switch receiving the trigger signal, and an antenna coupled to the current switch, wherein the antenna outputs the impulse in accordance with the trigger signal.

2. The method of claim 1, wherein the data signal is outputted without delay to the data signal path.

3. The methods of claim 1, wherein an edge-sharpening amplifier sharpens the edge of the trigger signal.

4. The method of claim 1, wherein the impulse is a positive impulse that is locked to a rising edge of the trigger signal or a falling edge of the trigger signal.

5. The method of claim 1, wherein an edge-sharpening amplifier receives the trigger signal, wherein the edge-sharpening amplifier sharpens the edge of the trigger signal that is outputted to the current switch or the delay generator.

6. The method of claim 1, further comprising outputting at least another impulse from at least one other impulse radiator from the array of impulse radiators; and setting desired delays for the another impulse radiator for beam steering or spatial combining.

7. The method of claim 6, wherein the impulse and the at least another impulse combine to enable a broadband beam-steering of information.

8. The method of claim 1, wherein the array of impulse radiators is utilized for spectroscopy, imaging, or high-speed wireless communication.

9. The method of claim 1, wherein a delay generator coupled to the trigger input controls a delay to the trigger signal.

10. An impulse radiator comprising:

a trigger input for receiving a trigger signal;

a data input for receiving a data signal, wherein a trigger signal path is separated from a data signal path;

a delay generator coupled to the trigger input, wherein the delay generator controls a delay to the trigger signal;

a digital-to-impulse (D2I) circuit receiving the trigger input and data signal, wherein the D2I circuit controls timing of a current applied to an antenna in accordance with the trigger signal that controls an output timing of an impulse, and the D2I circuit controls amplitude of the current applied to the antenna in accordance with the data signal that controls the amplitude of the impulse; and an antenna coupled to the D2I circuit, wherein the antenna outputs the impulse in accordance with the trigger signal.

11. The radiator of claim 10, wherein the data signal is outputted to the D2I circuit without delay to the data signal path.

12. The radiator of claim 10, wherein the D2I circuit comprises:

an edge-sharpening amplifier, wherein the edge-sharpening amplifier sharpens the edge of the trigger signal; and a current switch, wherein the current switch controls the current applied to the antenna.

13. The radiator of claim 10, wherein the D2I circuit comprises:

an impulse matcher outputting the trigger signal to the antenna; and a digital to analog (DAC) converter receiving a delay control signal, wherein the DAC converter modulates the delay of the impulse in accordance with the delay control signal.

14. The radiator of claim 10, where the radiator is an integrated circuit.

15. The radiator of claim 10, wherein the impulse is a positive impulse that is locked to a rising edge of the trigger or a falling edge of the trigger.

16. The radiator of claim 10, wherein the impulse radiator is a component of an array of impulse radiators.

17. The radiator of claim 16, wherein setting a proper delay at each impulse radiator is utilized for beam steering or spatial combining.

18. The radiator of claim 16, wherein the array of impulse radiators is utilized for spectroscopy, imaging, or high-speed wireless communication.

19. A digital-to-impulse system comprising:

an array of impulse radiators with two or more impulse radiators, wherein at least one impulse radiator of the array comprises a trigger input for receiving a trigger signal;

a data input for receiving a data signal, wherein a trigger signal path is separated from a data signal path;

a delay generator coupled to the trigger input, wherein the delay generator controls a delay to the trigger signal;

a digital-to-impulse (D2I) circuit receiving the trigger input and data signal, wherein the D2I circuit controls timing of a current applied to an antenna in accordance with the trigger signal that controls an output timing of an impulse, and the D2I circuit controls amplitude of the current applied to the antenna in accordance with the data signal that controls the amplitude of the impulse; and an antenna coupled to the D2I circuit, wherein the antenna outputs the impulse in accordance with the trigger signal.

20. The system of claim 19, wherein at least another impulse from two or more impulse radiators is outputted, and the output timing of the impulse relative to said another impulse is utilized for beam steering or spatial combining.

21. The system of claim 19, wherein each of the impulse radiators in the array comprises a trigger input, data input, D2I circuit, and antenna, and beam-steering of radiated impulses is enabled by setting a proper delay at each of the impulse radiators.

22. The system of claim 21, wherein radiated impulses from the array enable broadband beamsteering of information.

23. The system of claim 19, wherein the array of impulse radiators is utilized for spectroscopy, imaging, or high-speed wireless communication.

* * * * *